US005405459A

United States Patent [19]

Miyamoto et al.

[11] Patent Number: 5,405,459

[45] Date of Patent: Apr. 11, 1995

[54] PRODUCTION PROCESS FOR PRODUCING HOLLOW STEEL TUBE OF HIGH STRENGTH

[75] Inventors: Noritaka Miyamoto; Masazumi Onishi, both of Toyota, Japan

[73] Assignee: Toyota Jidosha Kabushiki Kaisha, Toyota, Japan

[21] Appl. No.: 137,363

[22] Filed: Oct. 18, 1993

[30] Foreign Application Priority Data

Oct. 16, 1992 [JP] Japan ..... 4-304665

[51] Int. Cl.[6] ..... C21D 9/08

[52] U.S. Cl. ..... 148/509; 148/519; 148/590

[58] Field of Search ..... 148/509, 519, 590, 909

[56] References Cited

U.S. PATENT DOCUMENTS 4,370,178 1/1983 Waid et al. ..... 148/909

FOREIGN PATENT DOCUMENTS 60-168910 9/1985 Japan .
61-265273 11/1986 Japan .
62-54021 3/1987 Japan .
63-53212 3/1988 Japan .
1178862 7/1989 Japan ..... 148/509
2-224973 9/1990 Japan .
1532595 12/1989 U.S.S.R. ..... 148/509

*Primary Examiner*—Deborah Yee
*Attorney, Agent, or Firm*—Finnegan, Henderson, Farabow, Garrett & Dunner

[57] ABSTRACT

A production process for producing a hollow steel tube of a high strength includes the steps of a tube preparation step of producing a seamless steel tube of a heavy thickness containing flaws of less than 0.25 mm in depth in an inner periphery thereof, a tube inner periphery correction step of correcting at least the flaws having a width of 0.001 mm or less so as to have a depth of 0.15 mm or less, and a hardening step of hardening the seamless steel tube across a whole thickness thereof to a hardness of from 450 to 670 in Vickers hardness (Hv). The production process enables not only to produce a hollow steel tube of a high strength at a less production cost but also to adapt it to exhibit such a high torsional fatigue fracture resistance and a high impact strength that it is applicable to axles for large size automobiles producing high outputs.

17 Claims, 15 Drawing Sheets

PRODUCTION PROCESS FOR PRODUCING HOLLOW STEEL TUBE OF HIGH STRENGTH

BACKGROUND OF THE INVENTION

1. Field of the Invention

The present invention relates to a production process for producing a hollow steel tube of a high strength which is applicable to automobile axles, or the like.

2. Description of the Related Art

There have been the lightweight requirements for vehicles such as automobiles, or the like. Accordingly, axles have been examined to hollow them out, and part of such attempts have been put into actual applications. The specifications of such hollow axles which have been put into actual applications by certain automobile manufactures are identical with each other more or less, and they can be summarized as follows:

Material Quality: S45C through S50C (as per Japanese Industrial Standard), carbon steel for mechanical structures, or the equivalents;

Hollowing Rate: approximately 50%, and the ratio of the inside diameter (hereinafter abbreviated to "I.D.") to the outside diameter (hereinafter abbreviated to "O.D."), i.e., I.D./O.D., falling in a range of from 0.45 to 0.55;

Hollowing Way: Drilling round bar stocks with a gun drill followed by reaming; and Heat Treatment: Induction hardening followed by tempering (Here, the hardening is carried out up to about a half of the thickness of the hollow axles.)

The S45C through S50C carbon steels were used to make the conventional hollow axles because the inner hardness was intended to be as high as possible in the unhardened portions while maintaining such high carbon contents that there arise no cracks resulting from the hardening.

Namely, when the induction hardening is carried out too deep, the crystalline grains become so coarse that the resulting hollow axles are deteriorated in the impact strength. Accordingly, the heat treatment is limitedly carried out only up to about a half of the thickness of the conventional hollow axles. Therefore, the conventional hollow axles hardened to the shallow depths cannot be applied to large size vehicles which produce high outputs, because they lack the torsional fatigue fracture resistances. It has been known that the torsional fatigue fracture resistances of the automobile axles depend greatly on the induction hardened depth. FIG. 17 illustrates the relationship between the torsional resistances and the hardened depths, relationship which was exhibited by the conventional hollow axles hardened to such shallow depths. In FIG. 17, solid diamonds (▲) designate the torsional resistance exhibited by the conventional hollow axles made from "TS" No. 1, and blank circles (◯) designate the torsional resistance exhibited by the conventional hollow axles made from "TS" No. 3. As illustrated in FIG. 17, the conventional hollow axles exhibited sharply deteriorating torsional resistances when the ratios of the hardened depths to the radii were 0.6 or less. Here, the conventional hollow axles were examined for the torsional resistances by twisting them with an increasing torque until they ruptured or broke.

With respect to the hollowing way, the conventional hollow axles were bored by machining the round bar stocks because there are no alternative ways available. In view of the productivity, it takes a long processing tact-time for such boring with the drill to complete hollowing out a round bar stock, and consequently it is needed to provide a plurality of the facilities therefor. As a result, the manufacturing cost for the conventional hollow axles increases sharply because of the costs of the facilities and the spaces to be secured in a manufacturing plant. Thus, it is impossible to actually hollow out all the axles for all types of vehicles currently manufactured.

As for the other hollowing way, one can think of using electrically-welded steel tubes, for example. However, it is impossible to produce electrically-welded tubes which have heavy thicknesses appropriate for the manufacture of the vehicle axles, because they are formed into the tubular shapes by welding thin steel strips.

Further, the production process for seamless steel tubes can make hollow steel tubes of desired sizes, e.g., I.D.'s. and O.D.'s., at the least expensive cost. However, in the manufacture of the seamless steel tubes, it is inevitable that the seamless steel tubes contain flaws in the peripheries. The flaws in the outer peripheries of the seamless steel tubes can be machined out in one of the manufacturing processes of the vehicle axles, but the flaws in the inner peripheries thereof are left as they are in the end. In addition, no analysis has been made extensively so far in order to verify how wide and deep the flaws can be so as not to render them the starting points of fatigue fracture in the resulting hollow steel tubes.

For instance, the present inventors examined the seamless steel tubes, which had I.D.'s and O.D.'s applicable to hollow axles, for the flaws, and they found that the seamless steel tubes contained the flaws of 0.3 mm in depth. These flaws are believed to result from the scratches which are caused by a rolling and boring machine in the boring process of the seamless steel tubes production process. Namely, the scratches are believed to be folded into the inner peripheries of the seamless steel tubes when the seamless steel tubes are drawn and rolled to a predetermined thickness, i.e., to a half of the differences between O.D.'s and I.D.'s, by a stretching reducer, and they are believed to be left in the inner peripheries as the flaws of such a deep depth.

SUMMARY OF THE INVENTION

The present invention has been developed in order to overcome the aforementioned shortcomings associated with the conventional hollow steel tubes for axles. It is therefore an object of the present invention to provide a process for producing a hollow steel tube of a high strength at a less expensive cost. It is another object of the present invention to produce a hollow steel tube which can exhibit a desired fatigue fracture resistance and a desired impact strength.

First of all, the present inventors investigated into the applicability of seamless steel tubes of heavy thicknesses to hollow axles. Namely, the seamless steel tubes production process was compared with the conventional drilling process in terms of the manufacturing costs for making hollow blanks for axles. As a result, when the seamless steel tubes production process is employed to make the hollow blanks for axles, although it pushed up the material cost and the cutting cost slightly, it was found to reduce the overall manufacturing cost by about 40% less than the conventional drilling process which requires to drill through the round bar stocks. This advantageous effect results from the fact that the seamless steel tubes production process does not require the boring process by drilling and the costs associated therewith.

However, the flaws produced in the inner peripheries of the hollow blanks during the seamless steel tubes production process have inhibited the production process from being applied to the production of axles, which are classified into critical safety related parts, so far. Therefore, the present inventors investigated into the influences of the flaws produced in the inner peripheries on the mechanical properties of the hollow blanks. For instance, they examined for the relationship between the widths and depths of the flaws and the fatigue fracture resistance of the hollow blanks. As a result, the present inventors found that the flaws do not adversely affect the fatigue fracture resistance of the hollow blanks, namely they do not constitute starting points of the fatigue fracture, as far as they have a width of more than a given dimension and a depth of a predetermined dimension or less.

The present inventors further investigated into the relationship between the hardened depth and the torsional fatigue fracture resistances of the hollow blanks as well as the surface residual stresses thereof. They found that, even if the hollow blanks are made from different metallic materials, they exhibit similar torsional fatigue fracture resistances and surface residual stresses so as to eventually exhibit similar fatigue fracture resistances when they are hardened across the whole thicknesses. Here, "being hardened across the whole thickness" means that the hollow blanks are hardened completely free from unhardened portions. If such is the case, it is easy to control the hardening operation even when the hollow blanks of different lengths are hardened in a single hardening line. Namely, it has been known that the hardened depths depend on the lengths of workpieces even when the workpieces are hardened under the same conditions. Hence, when the hardening condition is adjusted to harden a workpiece of a length, which is to be hardened to the shallowest depth under the condition, across the whole thickness, the other workpieces can be automatically hardened across the whole thicknesses under the condition.

However, the present inventors Found that the impact strengths exhibited by the hollow blanks depend greatly on the compositions of the metallic materials even when they are hardened across the whole thicknesses. Accordingly, they further investigated into the relationship between the compositions of the metallic materials forming the hollow blanks and the impact strengths exhibited thereby. As a result, they found that some of the additive elements have influences not only on the hardenability of the hollow blanks but also on the impact strengths exhibited thereby.

The present inventors furthermore investigated into the compositions of the metallic materials forming the hollow blanks. As a result, they found that the less the compositions include sulfur (S), the more enhanced impact strengths are exhibited by the hollow blanks.

The present inventors moreover investigated into the relationship between the hardnesses of the hollow blanks and the fatigue fracture resistances exhibited thereby. As a result, they found that, even if the hollow blanks are hardened across the whole thicknesses, they do not exhibit a predetermined fatigue fracture resistance unless they are hardened to a hardness falling in a predetermined range.

The present inventors thus completed a production process for producing a hollow steel tube of a high strength according to the present invention. The production process comprises the steps of:

a tube preparation step of producing a seamless steel tube of a heavy thickness containing flaws of less than 0.25 mm in depth in an inner periphery thereof;

a tube inner periphery correction step of correcting at least the flaws having a width of 0.001 mm or less so as to have a depth of 0.15 mm or less; and a hardening step of hardening the seamless steel tube across a whole thickness thereof to a hardness of from 450 to 670 in Vickers hardness (Hv).

In the present tube preparation step, it is preferred that the seamless steel tube is made from steel including at least one element selected from the group consisting of Mn in an amount of from 1.0 to 2.0% by weight, Cr in an amount of from 0.6 to 1.3% by weight, B in an amount of from 0.0005 to 0.0030% by weight and Mo in an amount of from 0.15 to 0.4% by weight. As a result, the austenitic crystal grains are micro-fined in the seamless steel tubes so that the seamless steel tubes can securely exhibit an impact strength of 400 kgf-m or more.

It is further preferred that the steel includes at least one element selected from the group consisting of Mn in an amount of from 1.35 to 2.0% by weight, Cr in an amount of from 0.8 to 1.3% by weight, B in an amount of from 0.0008 to 0.0030% by weight, and Mo in an amount of from 0.2 to 0.35% by weight. In addition, it is preferred that the sulfur (S) contents fall in a range of from 0.005 to 0.015% by weight in the materials constituting the seamless steel tubes.

In the present tube preparation step, it is preferred to carry out a nondestructive inspection which can successfully examine the resulting seamless steel tubes for the flaws in the inner periphery whether the flaws have a depth of less than 0.25 mm. When the seamless steel tubes are found to contain the flaws having the depth of 0.25 mm or more by the nondestructive inspection, they can be removed and then processed into seamless steel tubes again, for instance, by re-melting and re-rolling.

In the present tube inner periphery correction step, the inner peripheries of the seamless steel tubes can be corrected, for instance, by grinding, honing, shot blasting, or the like. For example, the inner peripheries of the seamless steel tubes can be shot blasted with a suction type shot blasting apparatus illustrated in FIG. 2. In short, this correction step can be carried out successfully as far as at least the flaws having the width of 0.001 mm or less are corrected so as to have the depth of 0.15 mm or less. In particular, it is not necessary to correct the flaws having a width of more than 0.001 mm and a depth of less than 0.25 mm because they do not render themselves as the starting points of the fatigue fracture. Namely, such flaws are not so sharp in cross-section to give a large stress to the resulting seamless steel tubes. During the correction step, the decarbonized layer is also removed from the inner peripheries. The decarbonized layer is formed by rolling the seamless steel tubes, and it is associated with low strengths. Hence, it is preferred that the seamless steel tubes are free from the decarbonized layer.

In the present hardening step, the seamless steel tubes can be hardened across the whole thicknesses to the hardness of from 450 to 670 in Vickers hardness (Hv) by adjusting the carbon contents in the materials constituting the seamless steel tubes or by adjusting a tempering temperature in a tempering step following the present hardening step.

In the present invention, the seamless steel tubes are corrected in the inner peripheries so that at least the flaws having the width of 0.001 mm or less are corrected so as to have the depth of 0.15 mm or less. Accordingly, the flaws in the inner peripheries of the resulting hollow steel tubes hardly constitute the starting points of the torsional fatigue fracture. Thus, it is possible to assure the qualities which are required for the automobile axles, one of the critical safety related parts. It is further preferred that the seamless steel tubes are corrected in the inner peripheries so that at least the flaws having the width of 0.001 mm or less are corrected to have a depth of 0.1 mm or less.

In the present invention, the seamless steel tubes are hardened across the whole thicknesses. Consequently, the resulting hollow steel tubes are improved in the fatigue fracture resistance, and thereby they are satisfactorily applicable to axles for large size automobiles which produce high outputs.

In addition, in the present invention, the seamless steel tubes are hardened across the whole thicknesses to the hardness of from 450 to 670 in Vickers hardness (Hv). Hence, the resulting hollow steel tubes can further securely exhibit a desired fatigue fracture resistance. It is further preferred that the seamless steel tubes are hardened across the whole thickness to a hardness of from 480 to 630 in rickets hardness (Hv).

The processing parameters of the present production process will be set forth below, and the reasons why they are limited as aforementioned in the present invention will be hereinafter described.

In the present invention, the seamless steel tubes are corrected in the inner peripheries so that at least the flaws having the width of 0.001 mm or less are corrected so as to have the depth of 0.15 mm or less. When the flaws have the width of 0.001 mm or less and the depth of more than 0.15 mm, such flaws come to constitute the starting points of the torsional fatigue fracture in the inner peripheries of the resulting hollow steel tubes, and thereby the hollow steel tubes are vulnerable to the torsional fatigue fracture. Accordingly, the hollow steel tubes cannot assure the qualities required for the automobile axles, one of the critical safety related parts.

In the present invention, the seamless steel tubes are hardened across the whole thickness to the hardness of from 450to 670 in Vickers hardness (Hv). When they are hardened to the hardness of less than 450 in Vickers hardness (Hv), the resulting hollow steel tubes do not securely exhibit the required fatigue fracture resistance. When they are hardened to the hardness of more than 670 in Vickers hardness (Hv), the resulting hollow steel tubes nevertheless exhibit deteriorated fatigue fracture resistances.

Mn can be included in the seamless steel tubes in the amount of from 1.0 to 2.0% by weight. Mn is one of the requisite elements which improve the hardenability of steel and micro-fine the crystal grains thereof so as to enhance the impact resistances of the resulting hollow steel tubes. When the Mn content is less than 1.0% by weight, the advantageous effects cannot be obtained sufficiently. When the Mn content is more than 2.0% by weight, the impact resistances are degraded adversely. Therefore, in the present production process, the seamless steel tubes can include Mn in the amount of from 1.0 to 2.0% by weight, preferably in an amount of from 1.35 to 2.0% by weight.

Cr can be included in the seamless steel tubes in the amount of from 0.6 to 1.3% by weight. Cr is one of the requisite elements which improve the hardenability of steel and micro-fine the crystal grains thereof so as to enhance the impact resistances of the resulting hollow steel tubes. When the Cr content is less than 0.6% by weight, no such advantageous effects can be obtained adequately. When the Cr content is more than 1.3% by weight, the advantageous effects have been saturated. Hence, in the present production process, the seamless steel tubes can include Cr in the amount of from 0.6 to 1.3% by weight, preferably in an amount of from 0.8 to 1.3% by weight.

Mo can be included in the seamless steel tubes in the amount of from 0.15 to 0.4% by weight. Mo is one of the requisite elements which improve the hardenability of steel and micro-fine the crystal grains thereof so as to enhance the impact resistances of the resulting hollow steel tubes. When the Mo content is less than 0.15% by weight, the advantageous effects cannot be obtained satisfactorily. When the Mo content is more than 0.4% by weight, the advantageous effects have been saturated. Therefore, in the present production process, the seamless steel tubes can include Mo in the amount of from 0.15 to 0.4% by weight, preferably in an amount of from 0.2 to 0.35% by weight.

B can be included in the seamless steel tubes in the amount of from 0.0005 to 0.0030% by weight. B is one of the requisite elements which improve the hardenability of steel and micro-fine the crystal grains thereof so as to enhance the impact resistances of the resulting hollow steel tubes. When the B content is less than 0.0005% by weight, no such advantageous effects can be obtained adequately. When the B content is more than 0.0030% by weight, the advantageous effects have been saturated. Hence, in the present production process, the seamless steel tubes can include B in the amount of from 0.0005 to 0.0030% by weight, preferably in an amount of from 0.0008 to 0.0030% by weight.

S can be included in the seamless steel tubes in the amount of from 0.005 to 0.015% by weight. S is one of the harmful elements which adversely affect the impact strengths of the resulting hollow steel tubes, and accordingly it is included in the seamless steel tubes as little as possible. However, S can be included in the seamless steel tubes in an amount of 0.015% by weight or less in order to securely give a desired impact strength to the resulting hollow steel tubes. On the other hand, When the S content is less than 0.005% by weight, it is hard to machine the resulting hollow steel tubes. Accordingly, the lower limit of the S content is set to 0.005% by weight. Thus, in the present production process, the seamless steel tubes can include S in the amount of of from 0.005 to 0.015% by weight, preferably in an amount of from 0.007 to 0.013% by weight.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIG. 4 (*b*) is a schematic cross-sectional view of the hardened solid steel bars;

FIG. 6 (*b*) is another schematic side view of the apparatus adapted for the drop test, and illustrates how to set the test specimen thereon;

DETAILED DESCRIPTION OF THE PREFERRED EMBODIMENTS

Figure 1:
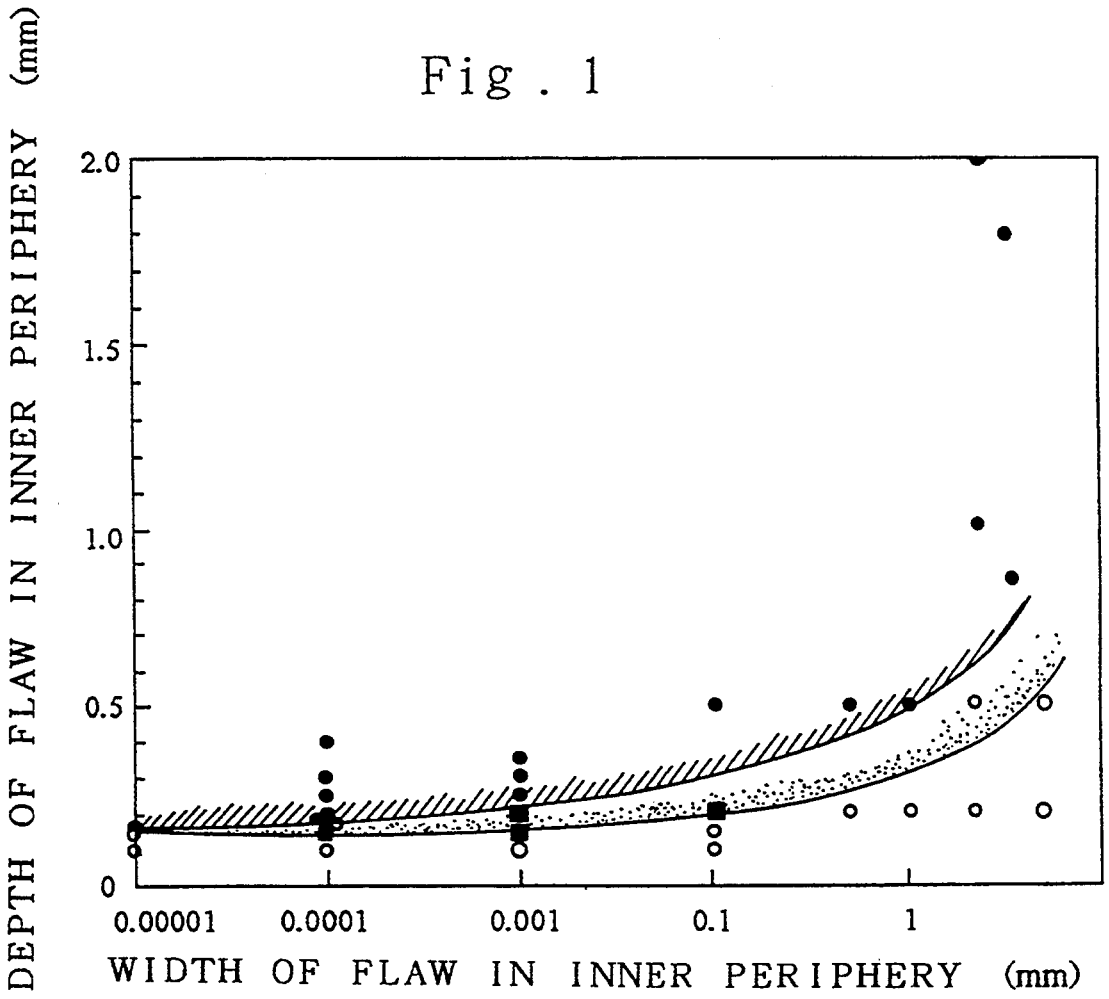
FIG. 1 is a scatter diagram illustrating the determination on how wide and deep the flaws are when they constitute the starting points of the torsional fatigue fracture in the inner peripheries of hollow steel tubes produced in accordance with the First Preferred Embodiment of the present invention.

Having generally described the present invention, a further understanding can be obtained by reference to the specific preferred embodiments which are provided herein for purposes of illustration only and ape not intended to limit the scope of the appended claims.

Hereinafter, the hollow steel tubes produced in accordance with the First through Seventh Preferred Embodiments of the present invention will be described in comparison with Comparative Example Nos. 1 through 4, and the advantageous effects associated therewith will be verified.

First Preferred Embodiment

Seamless steel tubes of a heavy thickness were rolled out of tubing steel (hereinafter abbreviated to "TS") No. 1 by a seamless tubing process, and they had an O.D. of 29.15 mm and an I.D. of 15 mm. The composition of the "TS" No. 1 is set forth in Table 1 below in the "Third Preferred Embodiment" section. The resulting seamless steel tubes were hardened across the whole thickness to 640 in Hv by induction hardening.

Then, the hardened seamless steel tubes were scratched artificially by electrical discharge machining so that they contained flaws having a large variety of widths and depths in their inner peripheries. In particular, the flaws had widths and depths as plotted in FIG. 1.

The seamless steel tubes thus artificially scratched were subjected to the torsional fatigue fracture resistance test. Here, the torsional fatigue fracture resistance test was carried out by twisting the seamless steel tubes for predetermined times (e.g., $2\times10^6$ times) of repetition while applying a predetermined torque to the seamless steel tubes, thereby examining whether the seamless steel tubes ruptured or broke. The seamless steel tubes were examined for how their torsional fatigue fracture resistances depended on the widths and depths of the flaws in accordance with the following experimental equation (1) proposed by Siebel and Stiler (VDI-Z: Bd. 97 Nr. 5 February 1955) on the cut-off effects:

$$K_f = K_t/\{1+(S_g \cdot \chi)^{\frac{1}{2}}\} \quad (1)$$

where $K_f$: Cut-off Factor, i.e., $K_f$=(Fatigue Resistance of Smooth Material)/(Fatigue Resistance of Cut-off Material Expressed in Nominal Stress), $K_t$: Stress Concentration Factor, i.e., $K_t$=(Stress in Cut-off Bottom)/(Nominal Stress)

$\chi$: Stress Gradient in Cut-off Bottom, and $S_g$: Material Constant.

In order to calculate the stress concentration factor "$K_t$" and the stress gradient "$\chi$," the flaws having a large variety of widths and depths were made artificially as aforementioned. Then, the flaws were examined for the stress concentration factor "$K_t$" and the stress gradient "$\chi$" in the bottoms by the finite-element method. In order to simulate the shapes of actual flaws, the artificial flaws were formed in shapes which extended in the rolling direction of the seamless steel tubes. There is no way available to obtain the material constant "$S_g$" other than experimentally. Hence, the seamless steel tubes were scratched artificially to contain flaws of known widths and depths in their inner peripheries by electrical discharge machining, and the seamless steel tubes containing the flaws of known widths and depths were actually subjected to the torsional fatigue fracture resistance test in order to calculate the material constant "$S_g$."

The thus calculated material constant "$S_g$" were regarded as the material constant "$S_g$" common to all the flaws. Finally, the cut-off factors "$K_f$" were calculated in accordance with Equation (1) by using the thus calculated stress concentration factor "$K_t$", the stress gradient "$\chi$" and the common material constant "$S_g$." Then the torsional fatigue fracture resistances of the artificially scratched seamless steel tubes, i.e., the cut-off materials, were calculated according to the cut-off factors "$K_f$," and they were compared with those of the seamless steel tubes free From the flaws, i.e., the smooth material, in order to judge whether the flaws were harmful to the seamless steel tubes. The results of the experiment are illustrated in FIG. 1 as a scatter diagram with respect to the depths "t" of the flaws in the inner peripheries and the widths "w" thereof. In FIG. 1, blank circles (○) designate the case where the flaws in the inner periphery did not constitute the starting points of the torsional fatigue fracture, and solid circles (●) designate the case where the flaws in the inner periphery constituted the starting points of the torsional fatigue fracture (i.e., the cut-off factor of the spline≦the cut-off factor of the flaws in the inner periphery. For reference, solid squares (■) designate the case where the flaws in the inner periphery might constitute or might not constitute the starting points of the torsional fatigue fracture. In this examination, the test specimens were the hollow steel tubes made from "TS" No. 1 which were induction hardened across the thickness to 640 in Hv, and which had an O.D. of 29.15 mm and an I.D. of 15 mm.

As illustrated in FIG. 1, the flaws designated with solid circles (e.g., having the widths and the depths positioned in the hatched area or above) constituted the starting points of the torsional fatigue fracture, the flaws designated with solid squares (e.g., having the widths and depths positioned between the hatched area and the dotted area) were transitional ones which might constitute or might not constitute the starting points of the torsional fatigue fracture, and the flaws designated with blank circles (e.g., having the widths and the depths positioned below the dotted area) hardly constituted the starting points of the torsional fatigue fracture. It is thus appreciated from FIG. 1 that the flaws having a width of 0.001 mm or less do not constitute the starting points of the torsional fatigue fracture when they have a depth of 0.15 mm or less. It was thus verified that such flaws are harmless to the resulting hollow steel tubes.

Second Preferred Embodiment

Figure 2:
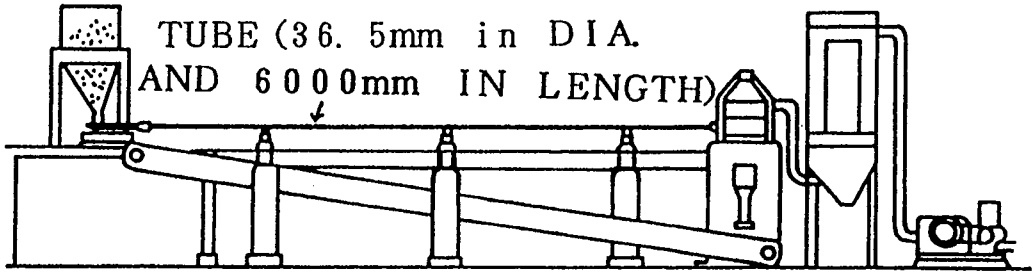
FIG. 2 is a schematic side view of a suction type shot blasting apparatus employed by the Second through Seventh Preferred Embodiments of the present invention.

Seamless steel tubes of a heavy thickness were rolled out of the "TS" No. 1 and S40C steel (as per Japanese Industrial Standard ) by a seamless tubing process, and them had an O.D. of 29.15 mm and an I.D. of 15 mm. The compositions of the "TS" No. 1 and the S40C steel are set forth in Table 1 below in the "Third Preferred Embodiment" section. The resulting seamless steel tubes were examined for their inner peripheries by a nondestructive inspection, e.g., an inspection using an electromagnetic ultrasonic thickness meter adapted for a leakage magnetic flux flaw detection, in order to select seamless steel tubes whose inner peripheries contain flaws having a depth of less than 0.25 mm. The selected seamless steel tubes were corrected with the suction type shot blasting apparatus illustrated in FIG. 2 and comprising a hopper for abrasive, a belt conveyor, a collector for the abrasive and a blower disposed in this order from left to right in the drawing, and thereby their inner peripheries were ground by 0.1 mm in order to correct at least the flaws having a depth of 0.001 mm or less to have a depth of 0.15 mm or less.

Figure 3:
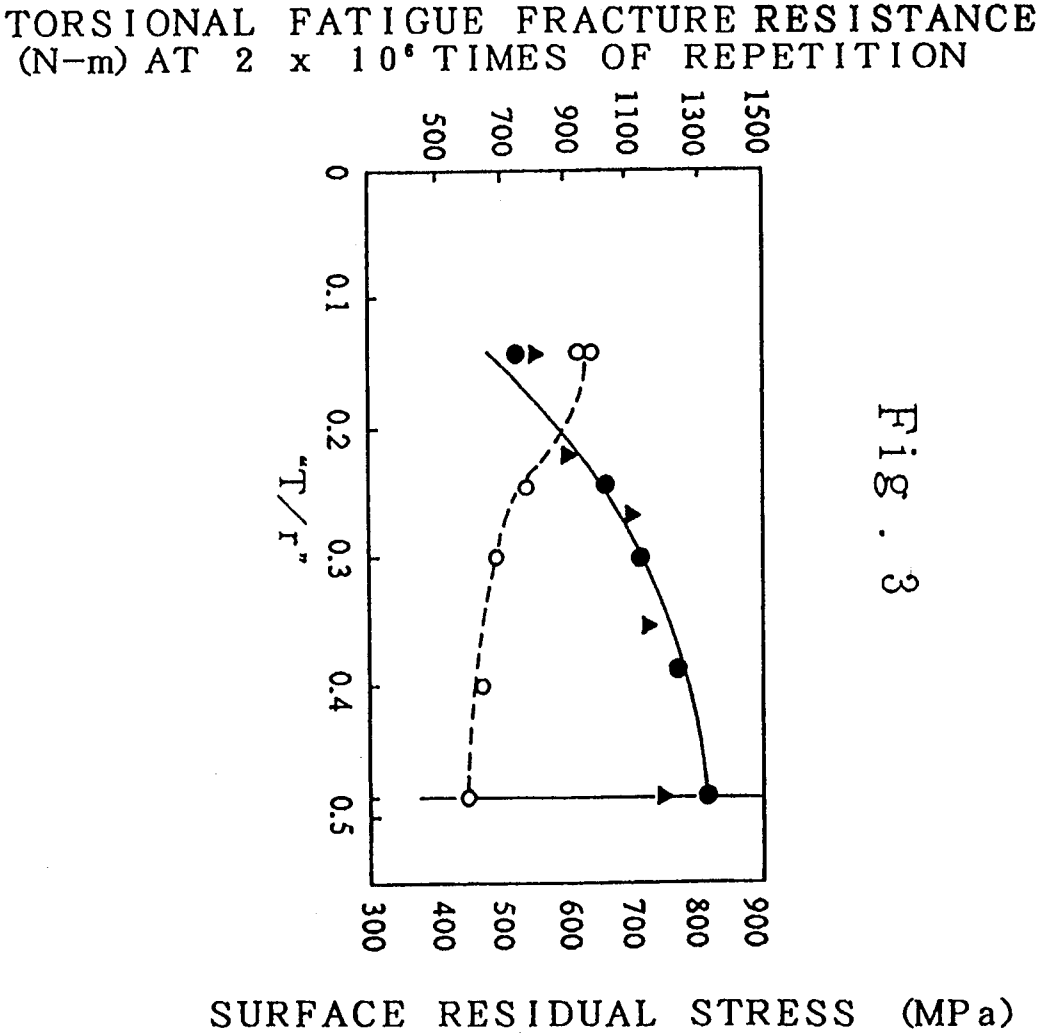
FIG. 3 is a diagram illustrating relationships between torsional fatigue fracture resistances and hardened depths, and between surface residual stresses and hardened depths exhibited by hollow steel tubes hardened to various hardened depths in accordance with the Second Preferred Embodiment.

The thus corrected seamless steel tubes were hardened by induction hardening to approximately 650 in Hv to a variety of hardened depths. Then, the resulting hollow steel tubes were examined for the torsional fatigue fracture resistances and the surface residual stresses. The torsional fatigue fracture resistances and the surface residual stresses thus obtained are plotted with respect to "T/r" (i.e., the ratios of the hardened depths "T" to the radii "r") in FIG. 3. In FIG. 3, solid circles (●) designate the torsional fatigue fracture resistance exhibited by the hollow steel tubes made from "TS" No. 1 at $2\times10^6$ times of repetition, solid triangles (▲) designate the torsional fatigue fracture resistance exhibited by the hollow steel tubes made from S40C steel there, and blank circles (○) designate the surface residual stress exhibited by the hollow steel tubes made from "TS" No. 1. In this examination, the test specimens were the hollow steel tubes made from "TS" No. 1 and S40C steel which were hardened to 650 in Hv, and which had an O.D. of 29.15 mm and an I.D. of 15 mm.

Figure 4:
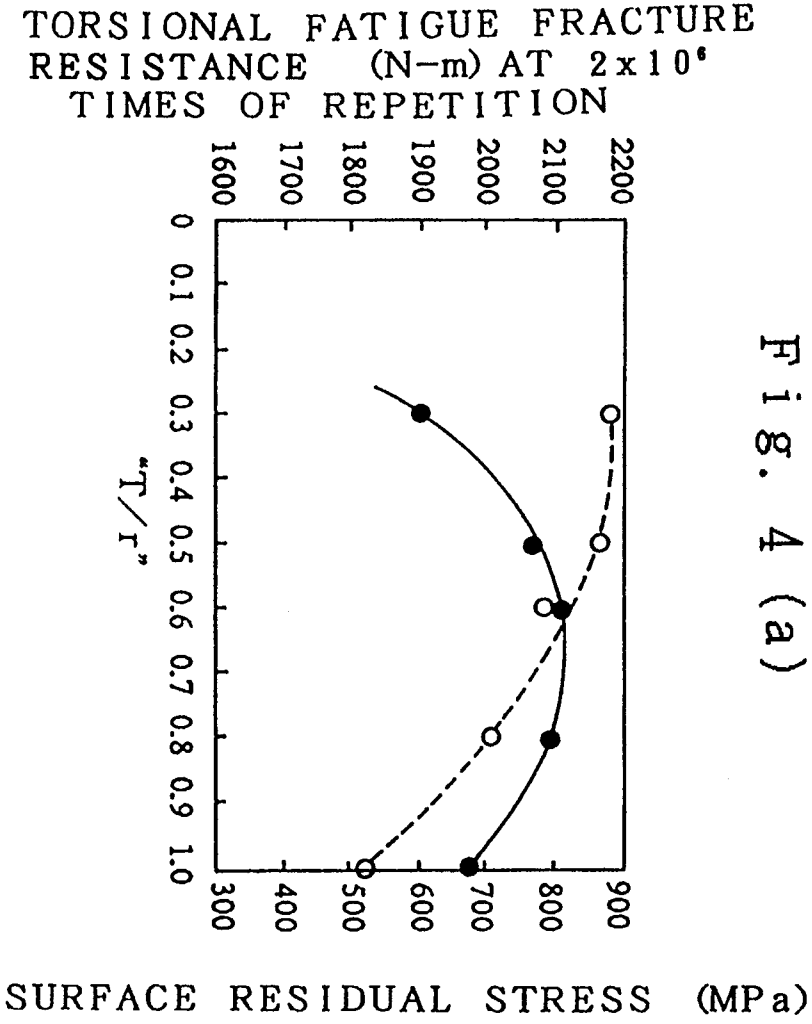
FIG. 4 (*a*) is a diagram illustrating relationships between torsional fatigue fracture resistances and hardened depths, and between surface residual stresses and hardened depths exhibited by solid steel bars (i.e., Comparative Example No. 1) hardened to various hardened depths.
Figure 4:
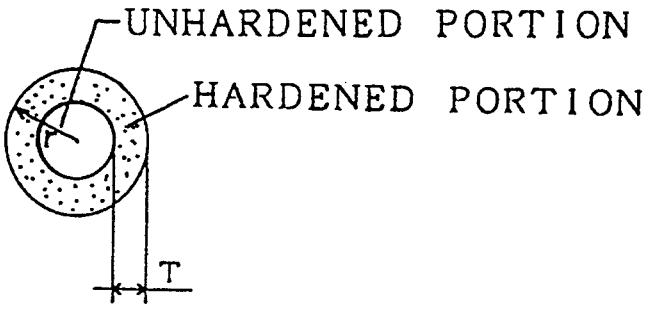

For comparison, solid steel bars were formed of the "TS" No. 1, and they were also hardened to approximately 650 in Hv to a variety of hardened depths. The hardened solid steel bars (i.e., Comparative Example No. 1) were examined for the torsional fatigue fracture resistances and the surface residual stresses. Likewise, the torsional fracture fatigue resistances and the surface residual stresses thus obtained are plotted with respect to "T/r" in FIG. 4. In FIG. 4 (*a*), solid circles (●) designate the torsional fatigue fracture resistance exhibited by the solid steel bars made from "TS" No. 1 at $2\times10^6$ times of repetition, and blank circles (○) designate the surface residual stress exhibited by the solid steel bars made from "TS" No. 1. In this examination, the test specimens were the solid steel bars made from "TS" No. 1 which were hardened to 650 in Hv, and which had an O.D. of 29.15 mm.

As illustrated in FIG. 3, the diagram illustrating the relationships between the torsional fatigue fracture resistances and the hardened depths, and between the surface residual stresses and the hardened depths exhibited by the hollow steel tubes produced in accordance with the Second Preferred Embodiment, the torsional fatigue fracture resistances were improved as the "T/r" increased. This phenomenon means that the hollow steel tubes do not deteriorate in the torsional fatigue fracture resistances even when they are hardened across the whole thickness. This results from the facts that the hollow steel tubes have low surface residual stresses originally as can be appreciated from FIG. 3 because they were hollow, and that their torsional fatigue fracture resistances depend greatly on their material strengths.

On the other hand, as illustrated in FIG. 4, the diagram illustrating the relationships between the torsional fatigue fracture resistances and the hardened depths, and between the surface residual stresses and the hardened depths exhibited by the solid steel bars prepared in accordance with Comparative Example No. 1, the solid steel bars exhibited the increasing torsional fatigue fracture resistances until the "T/r" reached 0.6, but they exhibited the decreasing torsional fatigue fracture resistances after the "T/r" surpassed 0.6. This results from the fact that, as illustrated with the dotted line in FIG. 4, the solid steel bars exhibited the surface residual stresses deteriorating sharply as the "T/r" increased.

Third Preferred Embodiment

According to the Second Preferred Embodiment, it was verified that, regardless of the modifications on the material qualities, the hollow steel tubes produced and hardened across the whole thickness in accordance with the Second Preferred Embodiment scarcely exhibited the differences between the torsional fatigue fracture resistances as far as they are hardened to the same hardness. However, this was not applicable to their impact strengths. Namely, it was found that, depending on the material qualities, the hollow steel tubes exhibit remarkably fluctuating impact strengths even when they are hardened across the whole thickness to the same hardness.

Hence, seamless steel tubes of a heavy thickness were rolled out of the "TS" No. 1 and the S40C steel by a seamless tubing process, and they had an O.D. of 29.15 mm and an I.D. of 15 mm. The compositions of the "TS" No. 1 and the S40C steel are set forth in Table 1 below. The resulting seamless steel tubes were examined for their inner peripheries by the nondestructive inspection set forth in the "Second Preferred Embodiment" section in order to select seamless steel tubes whose inner peripheries contained flaws having a depth of less than 0.25 mm. The selected seamless steel tubes were corrected with the suction type shot blasting apparatus illustrated in FIG. 2, and thereby their inner peripheries were ground by 0.1 mm in order to correct at least the flaws having a width of 0.001 mm or less to have a depth of 0.15 mm or less.

TABLE 1

| Elements (% by weight) | "TS" No. 1 | S40C |
|---|---|---|
| C | 0.40 | 0.40 |
| Si | 0.27 | 0.21 |
| Mn | 1.50 | 0.74 |
| P | 0.011 | 0.021 |
| S | 0.008 | 0.020 |
| Cr | 0.17 | 0.16 |
| Ni | 0.03 | none |

TABLE 1-continued

| Elements (% by weight) | "TS" No. 1 | S40C |
|---|---|---|
| Ti | 0.019 | nons |
| B | 0.0019 | none |

Figure 5:
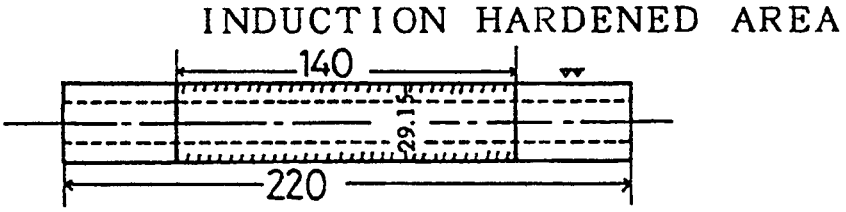
FIG. 5 is a side view of a test specimen for a drop test to which hollow steel tubes produced in accordance with the Third Preferred Embodiment were subjected.

The thus prepared seamless steel tubes were cut to a length of 220 mm, and, as illustrated in FIG. 5, they were hardened at the intermediate portion in a length of 140 mm by induction hardening to a hardness of 570 in Hv across the whole thickness.

Figure 6:
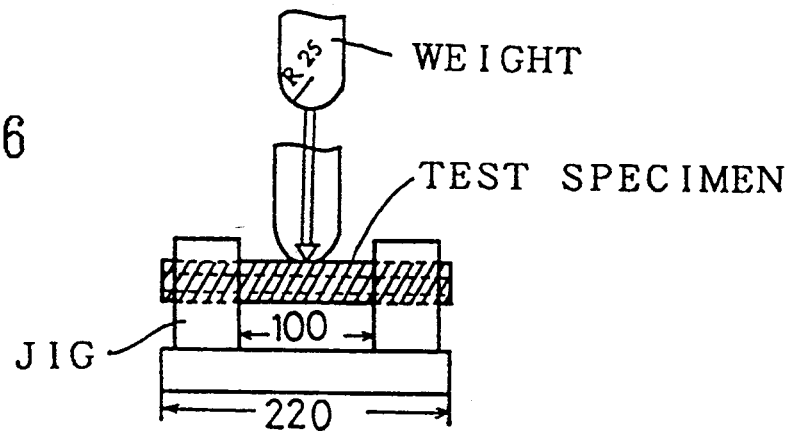
FIG. 6 (*a*) is a schematic side view of an apparatus adapted for the drop test, and illustrates how to set the test specimen thereon.
Figure 6:
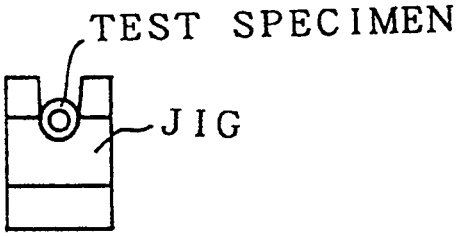

The resulting hollow steel tubes were subjected to a drop test using the apparatus illustrated in FIG. 6, and they were examined for their impact strengths by varying the impact energies (i.e., by dropping a weight from various heights). The results of the drop test are set forth in Table 2 below.

TABLE 2

| Impact Energy (kgf-m) | Weight Height (m) | H.S.T. made from "TS" No. 1 and hardened across the whole thickness | H.S.T. made from S40C and hardened across the whole thickness |
|---|---|---|---|
| 100 | 0.5 | | |
| 150 | 0.75 | | N. C., N. C. |
| 200 | 1.0 | | |
| 250 | 1.25 | N. C., N. C. | N. C., N. C. |
| 300 | 1.5 | | N. C., C. |
| 350 | 1.75 | | B., B. |
| 400 | 2.0 | N. C., N. C. | B. |
| 450 | 2.25 | | |
| 500 | 2.5 | N. C., N. C. | |
| 550 | 2.75 | N, C., N. C. | |
| 600 | 3.0 | N, C., C. | |

Note:
H.S.T.: Hollow Steel Tubes
N. C.: No Cracks
C.: Cracked
B.: Broken

As set forth in Table 1, the S40C steel does not include Mn, Cr and S in the predetermined amounts in accordance with the present invention, and they are free from Mo and B. As can be appreciated from Table 2, there arose the cracks in the hollow steel tubes made from the S40C steel when they were subjected to the impact energy of 300 kgf-m. Thus, the hollow steel tubes made from the S40C steel were found to be inferior in the impact strength.

On the other hand, as set forth in Table 1, the "TS" No. 1 includes Mn, Cr, B and S in amounts of 1.50%, 0.17%, 0.0019% and 0.008%, respectively, by weight. As can be appreciated from Table 2, there arose no cracks in the hollow steel tubes made from the "TS" No. 1 even when they were subjected to the impact energy of up to 550 kgf-m.

Hence, it was found that, depending on the material qualities, the hollow steel tubes exhibit remarkably fluctuating impact strengths even when they are hardened across the whole thickness to the same hardness.

Figure 7:
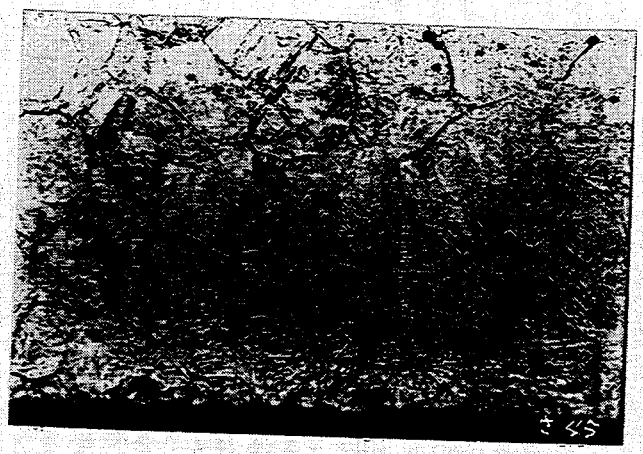
FIG. 7 is a photomicrograph on a metallic structure of one of the hollow steel tubes produced in accordance with the Third Preferred Embodiment.
Figure 8:
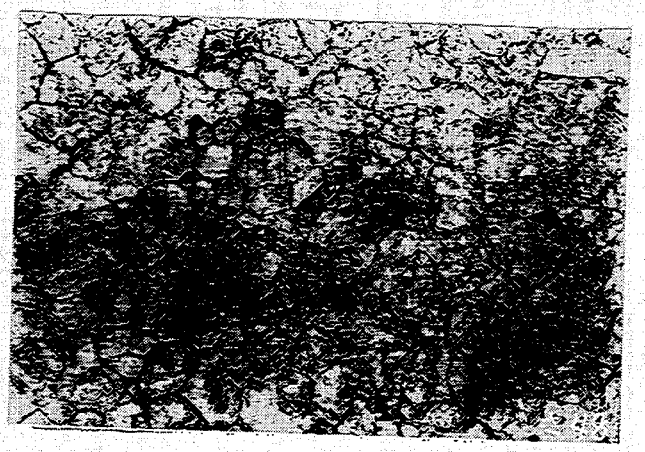
FIG. 8 is a photomicrograph on a metallic structure of another one of the hollow steel tubes produced in accordance with the Third Preferred Embodiment.

In order to further investigate the causes of the dependency of the impact strength on the material qualities, the hollow steel tubes were examined with a microscope for the sizes of the austenitic crystal grains. FIG. 7 is the photomicrograph on the metallic structure of the hollow steel tube made from the S40C steel. FIG. 8 is the photomicrograph on the metallic structure of the hollow steel tube made from the "TS" No. 1. It is apparent from FIGS. 7 and 8 that the sizes of the austenitic crystal grains formed in the hollow steel tube made from the S40C steel were from 3 to 5 times larger than the sizes of those formed in the hollow steel tubes made from the "TS" No. 1. It was thus acknowledged that the impact strength is likely to be influenced by the grain sizes, and that there arise the remarkable differences in the impact strengths between the hollow steel tubes made from the S40C steel and those made from the "TS" No. 1.

The reason why the grain size differences cause the remarkably fluctuating impact strengths are believed to result from the hardening abilities of the materials. Namely, the S40C steel is virtually free from the additive elements capable of improving the hardening ability, and the hardening temperature should be adjusted higher in order to harden the seamless steel tubes made from such a material across the whole thickness, e.g., to the hardening depth of about 7.1 mm (i.e., $7.1=(29.15-15)/2$) as in the First through Third Preferred Embodiments. For example, the seamless steel tubes made from the S40C steel could be hardened at 1,060° C. in order to harden across the whole thickness, and the seamless steel tubes made from the "TS" No. 1 could be hardened at 920° C. in order to harden across the whole thickness.

Fourth Preferred Embodiment

Mn, Cr, B and Mo are the additive elements which are said to improve the hardening ability, i.e., "J" value, in general. In order to evaluate how the additive elements affect the impact strengths of the hollow steel tubes, Mn, Cr, B and Mo were added to the simple S40C steel one by one in the predetermined amounts, and the resulting four steel raw materials were melted with a vacuum smelting Furnace of 50 kg capacity to produce ingots. The ingots were rolled to prepare solid bar stocks, and the resulting solid bar stocks were drilled to prepare hollow steel tubes having an O.D. of 29.15 mm and an I.D. of 15 mm. The thus prepared hollow steel tubes were cut to a length of 220 mm, and they were hardened at the intermediate portions in a length of 140 mm by induction hardening under the conditions that they were allowed to be hardened across the whole thickness at the lowest possible hardening temperatures.

Figure 9:
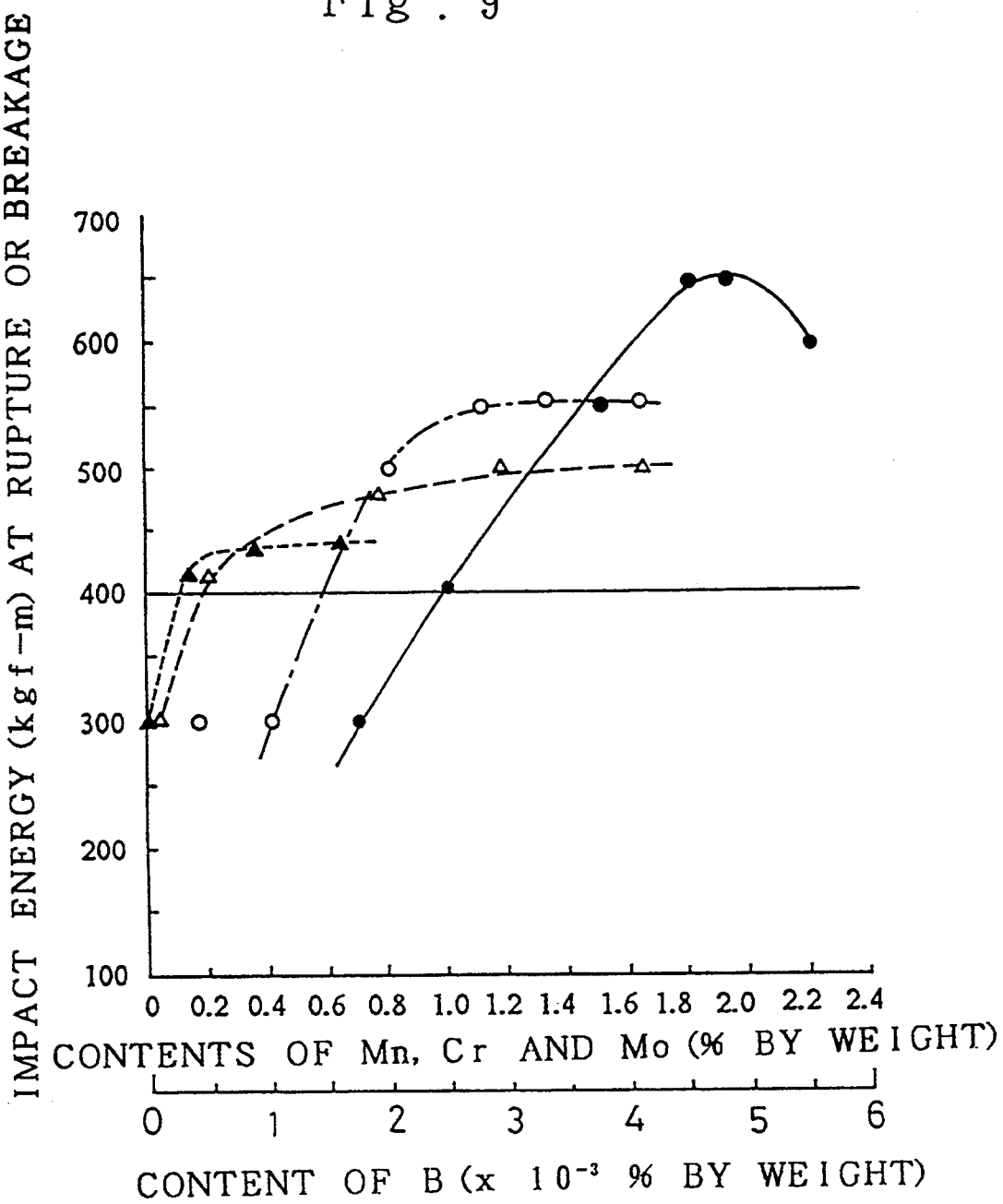
FIG. 9 is a diagram illustrating relationships between impact energies at rupture or breakage and contents of additive elements, relationships which were exhibited by hollow steel tubes produced in accordance with the Fourth Preferred Embodiment.

The hollow steel tubes thus hardened across the whole thickness were subjected to the drop test set forth in the "Third Preferred Embodiment" section, and they were examined for their impact strengths by varying the impact energies. The results of the drop test are illustrated in FIG. 9. In FIG. 9, solid circles (●) designate the impact energy exhibited by the hollow steel tubes made from S40C steel with Mn added, blank circles (○) designate the impact energy exhibited by the hollow steel tubes made from S40C steel with Cr added, solid triangles (▲) designate the impact energy exhibited by the hollow steel tubes made from S40C steel with Mo added, and blank triangles (Δ) designate the impact energy exhibited by the hollow steel tubes made from S40C steel with B added. In this examination, the test specimens were the hollow steel tubes which had an O.D. of 29.15 mm and an I.D. of 15 mm.

As can be seen from FIG. 9, all of the hollow steel tubes made from the four steel raw materials including one of Mn, Cr, Mo and B exhibited the impact strengths which increased in proportion to the contents of the additive elements up to the certain contents, and which approached to certain values or decreased thereafter.

When the hollow steel tubes are used for automotive axles, they are required to exhibit an impact strength of 400 kgf-m or more. If such is the case, the following lower and upper limits on the content ranges of the additive elements can be derived from FIG. 9. Namely, Mn can be included in an amount of 1.0% by weight or more, Cr can be included in an amount of 0.6% by weight or more, No can be included in an amount of 0.15% by weight or more, and B can be included in an amount of 0.0005% by weight or more. Then, let the upper limits be the additive elements contents from which the hollow steel tubes exhibited the impact strengths approaching to certain values, Mn can be included in an amount of 2.0% by weight or less, Cr can be included in an amount of 1.3% by weight or less, Mo can be included in an amount of 0.4% by weight or less, and B can be included in an amount of 0.0030% by weight or less.

In addition, a one-to-one relationship was observed between the impact strengths and the grain sizes of the gamma crystal grains. In other words, the contents of the additive elements determine the hardening temperatures, and the hardening temperatures determine the impact strengths. Here, the impact strengths were the ones exhibited by the hollow steel tubes including one of the additive elements in the aforementioned contents, and the grain sizes of the gamma crystal grains were in the metallic structures containing the one of the additive elements in the aforementioned contents.

Fifth Preferred Embodiment

Figure 10:
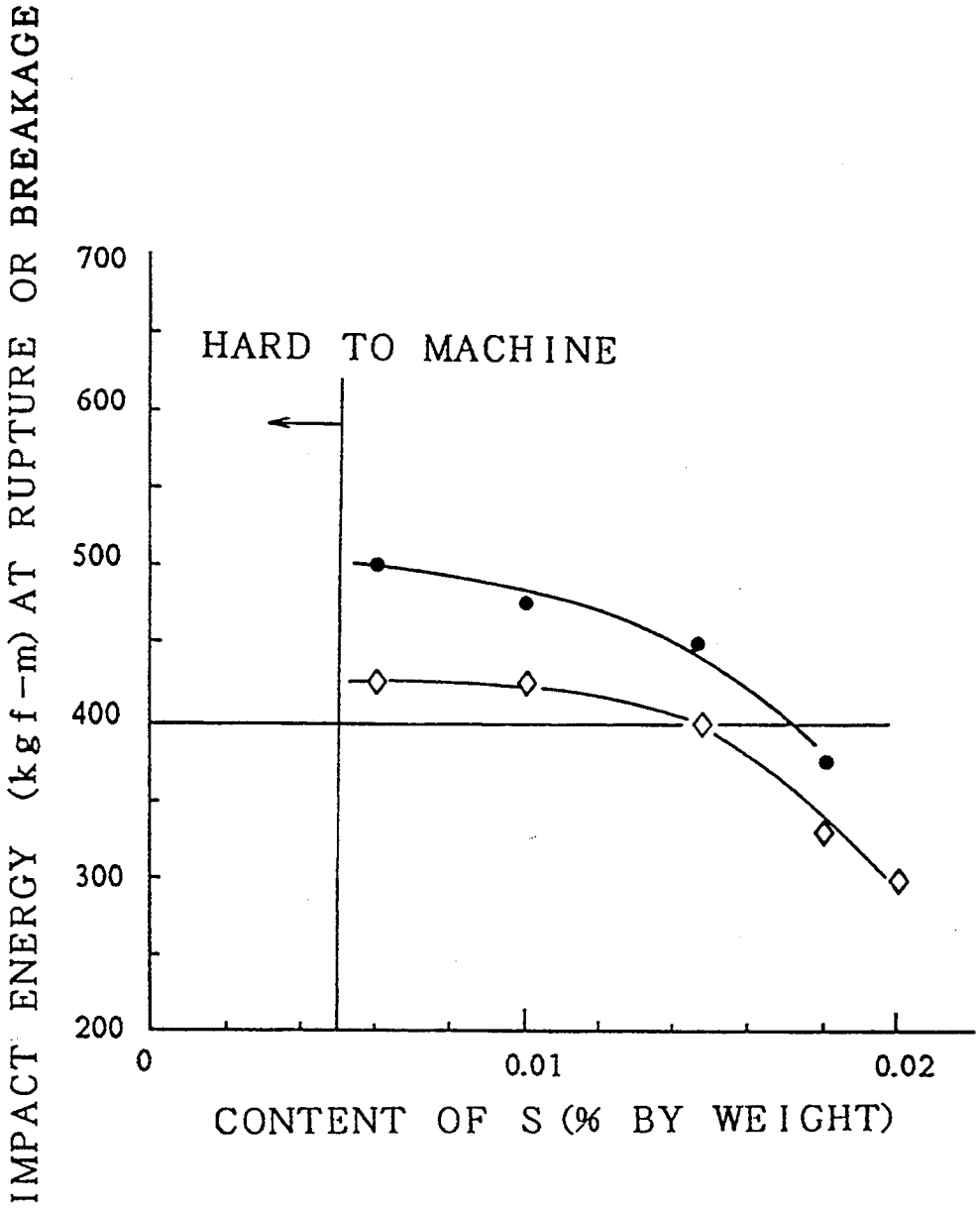
FIG. 10 is a diagram illustrating relationships between impact energies at rupture or breakage and contents of additive sulfur (S) elements, relationships which were exhibited by hollow steel tubes produced in accordance with the Fifth Preferred Embodiment.

In order to evaluate how sulfur (S) affects the impact strengths of the hollow steel tubes, S was added to the simple S40C steel in various amounts, and the resulting steel raw materials were melted with a vacuum smelting furnace of 50 kg capacity to produce ingots. Additionally, Mn was added to the simple S40C steel in an amount of 1.0% by weight so as to prepare a modified S40C steel, S was further added to the modified S40C steel in various amounts, and the resulting steel raw materials were similarly processed into ingots. Likewise, the two kinds of the ingots were processed into the hollow steel tubes in the same manner as described in the "Fourth Preferred Embodiment" section, and they were subjected to the drop test set forth in the "Third Preferred Embodiment" section. The results of the drop test are illustrated in FIG. 10. FIG. 10 shows two relationships between the S contents and the impact energies at rupture or breakage. In FIG. 10, solid circles (●) designate the impact energy exhibited by the hollow steel tubes made from modified S40C steel with Mn added in an amount of 1.0% by weight, and blank diamonds (◇) designate the impact energy exhibited by the hollow steel tubes made from simple S40C steel. In this examination, the test specimens were the hollow steel tubes which had an O.D. of 29.15 mm and an I.D. of 15 mm.

It is apparent from FIG. 10 that the impact energies increased as the S contents decreased. Namely, the hollow steel tubes exhibited the impact strengths improving as the S contents decreased. Let a target value of the impact strength be 400 kgf-m, the hollow steel tubes made from the simple S40C steel could satisfy the target value when S was added in an amount of 0.015% or less. This resulted from the fact that the S elements are likely to be segregated in the grain boundaries, and that they deteriorate the strengths at the grain boundaries. However, the hollow steel tubes made from the S40C steels were hard to machine when the steels included S in an amount of less than 0.005% by weight. Hence, the lower limit of the S content can be set at 0.005% by weight preferably. It was thus verified that the hollow steel tubes can be made preferably from steel including S in the amount of from 0.005% to 0.015% by weight so that they can exhibit the impact strength of 400 kgf-m or more.

It is also appreciated from FIG. 10 that the hollow steel tubes made from the S40C steel modified with Mn came to exhibit the required impact strength when S was added to the modified S40C steel in a lesser amount, and that they exhibited far better impact strengths than the hollow steel tubes made from the simple S40C steel with S added in the same amount.

Sixth Preferred Embodiment

Seamless steel tubes of a heavy thickness were rolled out of "TS" No. 2 and "TS" No. 3 by a seamless tubing process, and they had an O.D. of 29.15 mm and an I.D. of 15 mm. The compositions of the "TS" No. 2 and the "TS" No. 3 are set forth in Table 3 below.

TABLE 3

| Elements (% by weight) | "TS" No. 2 | "TS" No. 3 |
|---|---|---|
| C | 0.34 | 0.45 |
| Si | 0.26 | 0.26 |
| Mn | 1.45 | 1.50 |
| P | 0.014 | 0.013 |
| S | 0.007 | 0.008 |
| Cr | 0.16 | 0.16 |
| Ni | 0.02 | 0.02 |
| Ti | 0.021 | 0.018 |
| B | 0.0020 | 0.0019 |

The resulting seamless steel tubes were examined for their inner peripheries by the nondestructive inspection set forth in the "Second Preferred Embodiment" section in order to select seamless steel tubes whose inner peripheries contained flaws having a depth of less than 0.25 mm. The selected seamless steel tubes were corrected with the suction type shot blasting apparatus illustrated in FIG. 2, and thereby their inner peripheries were ground by 0.1 mm in order to correct at least the flaws having a width of 0.001 mm or less to have a depth of 0.15 mm or less.

Figure 11:
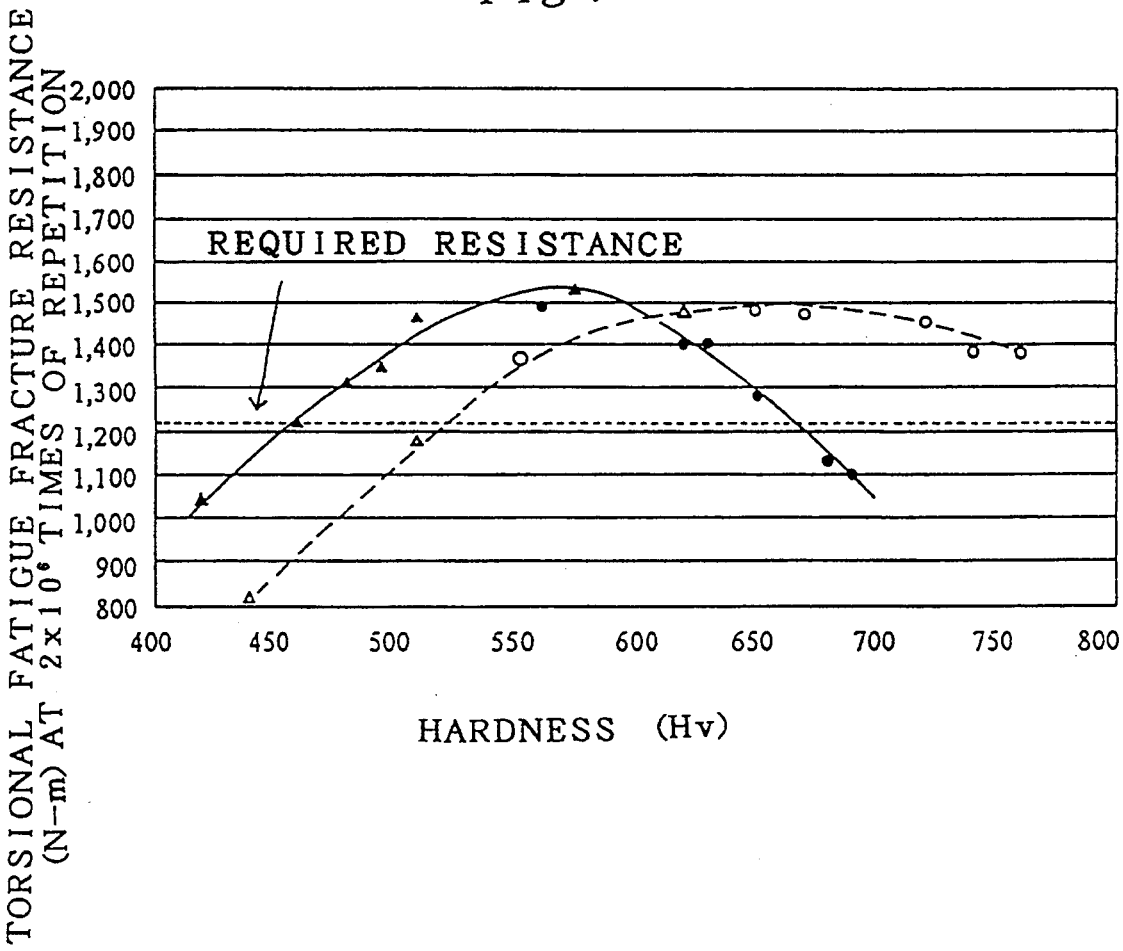
FIG. 11 is a diagram illustrating relationships between torsional fatigue fracture resistances and hardnesses, relationships which were exhibited by hollow steel tubes produced in accordance with the Sixth Preferred Embodiment, and by solid steel bars (i.e., Comparative Example No. 2)

Then, the thus corrected seamless steel tubes were machined to provide splines at their ends, they were hardened across the whole thickness by induction hardening, and they were adjusted to exhibit a variety of hardnesses in Hv by varying the tempering temperatures. The resulting hollow steel tubes, provided with splines at the ends, were examined for the torsional fatigue fracture resistances. The torsional fatigue fracture resistances thus obtained are plotted with respect to the hardnesses in FIG. 11. In FIG. 11, blank triangles (△) designate the torsional fatigue fracture resistance exhibited by the solid steel bars made from "TS" No. 2, blank circles (○) designate the torsional fatigue fracture resistance exhibited by the solid steel bars made from "TS" No. 3, solid triangles (▲) designate the torsional fatigue fracture 2, and solid circles (●) designate the torsional fatigue fracture resistance exhibited by the hollow steel tubes made from "TS" No. 3. In this examination, the test specimens were the hollow steel tubes made from "TS" No. 2 and No. 3 which were hardened across the thickness, and which had an O.D. of 29.15 mm and an I.D. of 15 mm, and the comparative test specimens were the solid steel bars made from "TS" No. 2 and No. 3 which were hardened to "T/r" of 0.55, and which had an O.D. of 27 mm.

For comparison, solid steel bars were formed of the "TS" No. 2 and the "TS" No. 3, and they had an O.D. of 27 mm. Likewise, the solid steel bars were machined to provide the splines at their ends, they were hardened to a depth of 7.4 mm (i.e., "T/r"=7.4/(27/2)=0.55), and they were adjusted to exhibit a variety of hardnesses in Hv by varying the tempering temperatures. The hardened solid steel bars (i.e., Comparative Example No. 2) were examined for the torsional fatigue fracture resistances. The torsional fatigue fracture resistances thus obtained are also plotted with respect to the hardnesses in FIG. 11.

As illustrated in FIG. 11, the hollow steel tubes (i.e., the Sixth Preferred Embodiment) exhibited the following torsional fatigue fracture resistances. Namely, the torsional fatigue resistances exceeded the required torsional fatigue fracture resistance, e.g., 1,210 N-m at $2\times10^6$ times of repetition, when the hollow steel tubes of the Sixth Preferred Embodiment were hardened to a hardness of 450 in Hv (i.e., the lower limit), they showed a peak and decreased sharply when the hollow steel tubes were hardened to a hardness of 570 in Hv or more. However, the hollow steel tubes satisfied the required resistance until they were hardened to a hardness of 670 in Hv (i.e., the upper limit). Accordingly, it was thus verified that the hollow steel tubes can reliably exhibit the desired torsional fatigue fracture resistance when they are hardened across the whole thickness to a hardness falling in a range of from 450 to 670 in Hv after tempering.

On the other hand, the solid steel bars (i.e., Comparative Example No. 2) exhibited the torsional fatigue fracture resistances which increased as the hardnesses increased up to 650 in Hv and which decreased slightly thereafter, and they exhibited the torsional fatigue resistances exceeding the required strength even when they were hardened to 750 or more in Hv. However, the solid steel bars exhibited the torsional fatigue fracture resistances satisfying the required resistance at last when they were hardened to 550 or more in Hv.

Moreover, the hollow steel tubes (i.e., the Sixth Preferred Embodiment) and the solid steel bars (i.e., Comparative Example No. 2) were visually examined for whether their breakages started either at their edges of the splines or at their ordinary outer peripheries. The results of the visual examinations are set forth in Tables 4 and 5 below. Table 4 summarizes the results of the visual examination on the hollow steel tubes of the Sixth Preferred Embodiment made from the "TS" No. 2, and Table 5 summarizes those on the solid steel bars of Comparative Example No. 2 made from the "TS" No. 3.

TABLE 4

| Hardness | 1,500* | 2,000* | 2,500* | 3,000* |
|---|---|---|---|---|
| Hv 460 | O.O.P. | O.O.P. | O.O.P. | O.O.P. |
| Hv 480 | O.O.P. | O.O.P. | O.O.P. | O.O.P. |
| Hv 495 | O.O.P. | O.O.P. | O.O.P. | O.O.P. |
| Hv 570 | O.O.P. | O.O.P. | O.O.P. | E.O.S. |
| Hv 620 | E.O.S. | E.O.S. | E.O.S. | E.O.S. |
| Hv 630 | E.O.S. | E.O.S. | E.O.S. | E.O.S. |
| Hv 650 | E.O.S. | E.O.S. | E.O.S. | E.O.S. |
| Hv 670 | E.O.S. | E.O.S. | E.O.S. | E.O.S. |

(Note)
*Torsional Fatigue Fracture Resistance (N-m) at $2\times10^6$ times of repetition
O.O.P.: Breakages started at ordinary outer periphery (O.O.P.)
E.O.S.: Breakages started at edges of splines (E.O.S.)

TABLE 5

| Hardness | 1,500* | 2,000* | 2,500* | 3,000* |
|---|---|---|---|---|
| Hv 440 | O.O.P. | O.O.P. | O.O.P. | O.O.P. |
| Hv 510 | O.O.P. | O.O.P. | O.O.P. | O.O.P. |
| Hv 550 | O.O.P. | O.O.P. | O.O.P. | O.O.P. |
| Hv 620 | E.O.S. | O.O.P. | O.O.P. | E.O.S. |
| Hv 670 | O.O.P. | O.O.P. | O.O.P. | E.O.S. |
| Hv 720 | O.O.P. | O.O.P. | E.O.S. | E.O.S. |
| Hv 740 | E.O.S. | E.O.S. | E.O.S. | E.O.S. |
| Hv 770 | E.O.S. | E.O.S. | E.O.S. | E.O.S. |

(Note)
*Torsional Fatigue Fracture Resistance (N-m) at $2 \times 10^6$ times of repetition
O.O.P.: Breakages started at ordinary outer periphery (O.O.P.)
E.O.S.: Breakages started at edges of splines (E.O.S.)

As can be understood from Tables 4 and 5, the hardness of 620 in Hv was a threshold hardness both for the hollow steel tubes of the Sixth Preferred Embodiment and the solid steel bars of Comparative Example No. 2. In other words, when the hollow steel tubes and the solid steel bars were hardened to a higher hardness (e.g., 620 or more in Hv), they came to break staring at their edges of the splines. This phenomenon results from the cut-off sensitivities of the blanks for the hollow steel tubes and the solid steel bars. Namely, it is said that the harder the blanks, the more sensitive the blanks are to the cut-off. Generally speaking, when blanks have cut-offs, their fatigue fracture resistances depend greatly on whether residual stresses arise therein or not, and how large the magnitudes of the residual stresses are. That is to say, blanks having cut-offs are associated with higher residual stresses, and they exhibit a remarkably larger fatigue fracture resistances.

Figure 12:
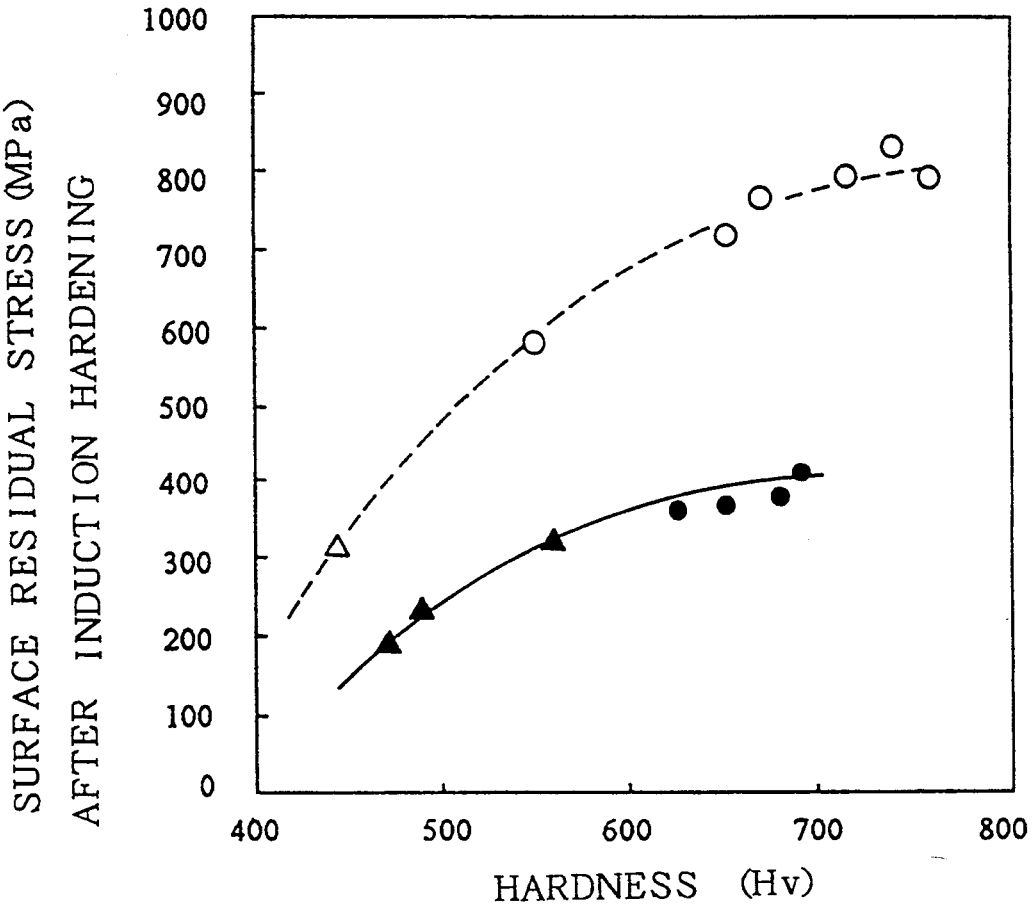
FIG. 12 is a diagram illustrating relationships between surface residual stresses and hardnesses, relationships which were exhibited by the hollow steel tubes produced in accordance with the Sixth Preferred Embodiment, and by the solid steel bars (i.e., Comparative Example No. 2)

For instance, the hollow steel tubes of the Sixth Preferred Embodiment and the solid steel bars of Comparative Example No. 2 were examined for their residual stresses arose therein. FIG. 12 illustrates the relationships between the residual stresses and the hardnesses exhibited by the hollow steel tubes and the solid steel bars. In FIG. 12, blank triangles (Δ) designate the surface residual stress exhibited by the solid steel bars made from "TS" No. 2, blank circles (◯) designate the surface residual stress exhibited by the solid steel bars made from "TS" No. 3, solid triangles (▲) designate the surface residual stress exhibited by the hollow steel tubes made from "TS" No. 2, and solid circles (●) designate the surface residual stress exhibited by the hollow steel tubes made from "TS" No. 3. As illustrated in FIG. 12, the solid steel bars exhibited the residual stresses approximately twice those of the hollow steel tubes. To put it differently, when the solid steel bars were hardened to 670 or more in Hv, they were verified to exhibit lower cut-off sensitivities than the hollow steel tubes did because higher residual stresses arose in them. On the other hand, the hollow steel tubes were verified to exhibit lower fatigue fracture resistances when they were hardened to an appropriate hardness or more (e.g., 670 or more in Hv), because there arose the cut-off effect or because they exhibited higher cut-off sensitivities.

Figure 13:
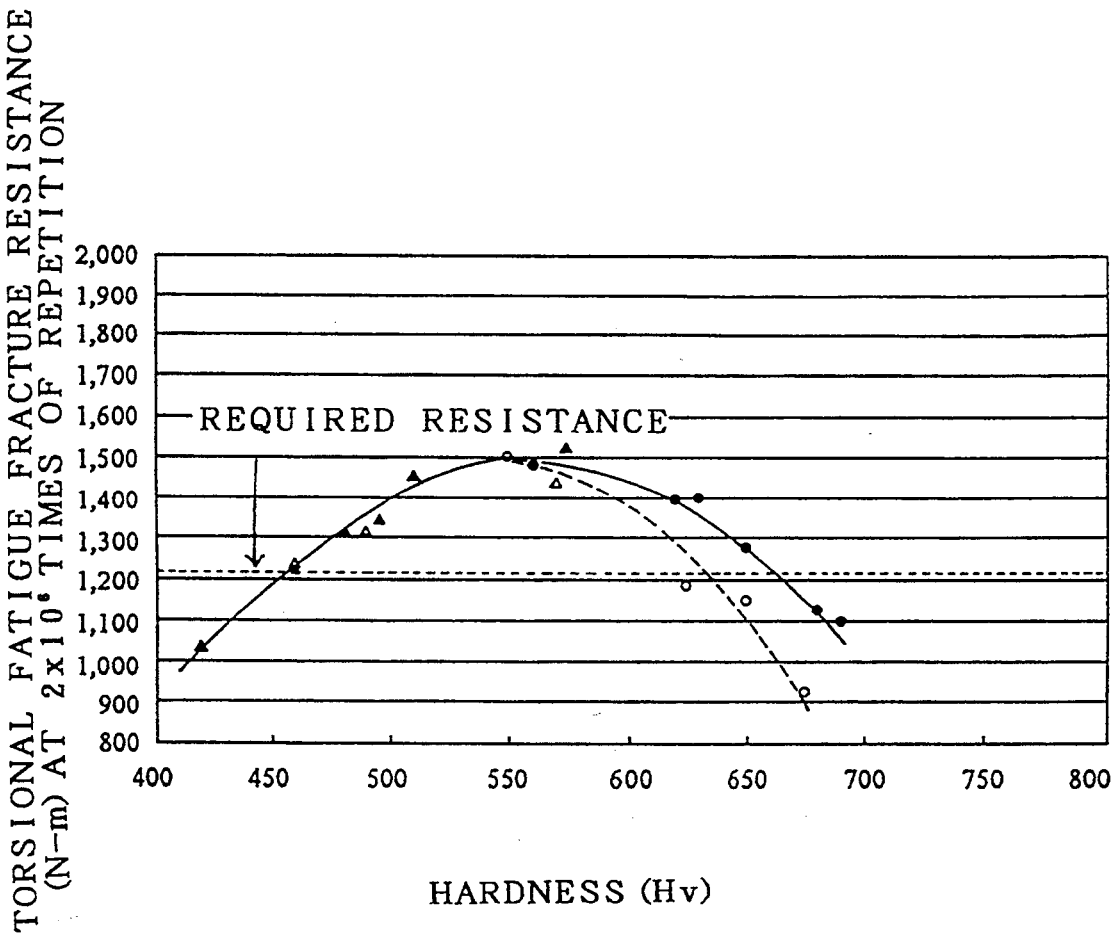
FIG. 13 is a diagram illustrating relationships between torsional fatigue fracture resistances and hardnesses, relationships which were exhibited by the hollow steel tubes corrected by shot blasting in accordance with the Sixth Preferred Embodiment, and by seamless steel tubes not corrected by the shot blasting (i.e., Comparative Example No. 3)
Figure 14:
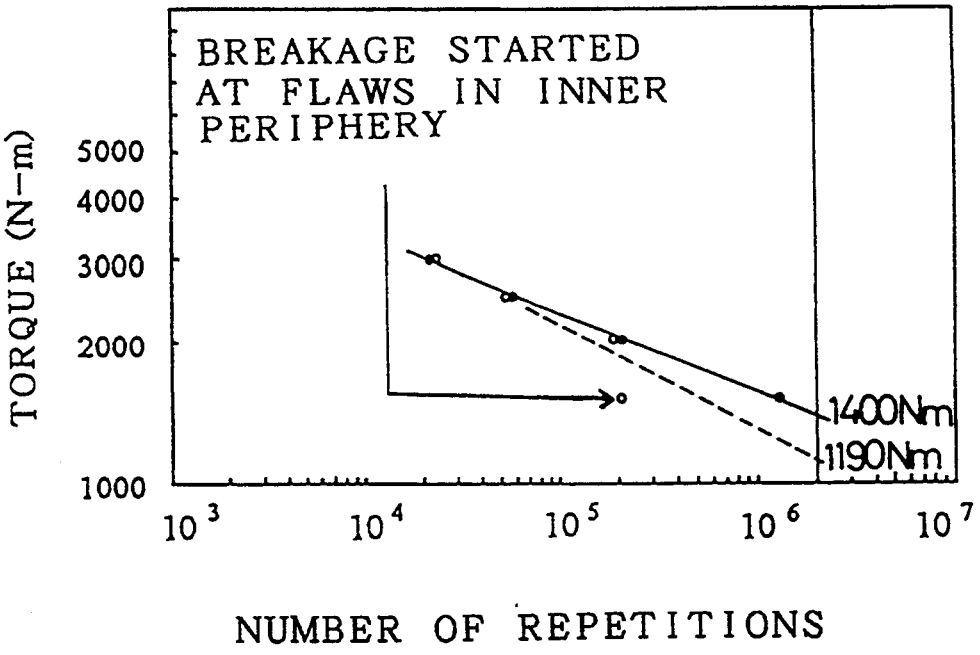
FIG. 14 is a diagram illustrating relationships between magnitudes of applied torques and numbers of torque applications, relationships which were exhibited by the hollow steel tubes corrected by the shot blasting in accordance with the Sixth Preferred Embodiment, and by the seamless steel tubes not corrected by the shot blasting (i.e., Comparative Example No. 3)

For extra comparison, seamless steel tubes of a heavy thickness were rolled out of the "TS" No. 2 and the "TS" No. 3 in the same manner as those of the Sixth Preferred Embodiment, and they were examined and selected in the same manner as those of the Second Preferred Embodiment. However, the selected seamless steel tubes were not subjected to the aforementioned correcting step, namely they were not shot blasted in the inner peripheries. Then, the selected seamless steel tubes were machined to provide splines at their ends, they were hardened across the whole thickness by induction hardening, and they were adjusted to exhibit a variety of hardnesses in Hv by varying the tempering temperatures. The thus prepared seamless steel tubes (i.e., Comparative Example No. 3) were examined for the torsional fatigue fracture resistances. The torsional fatigue fracture resistances thus obtained are plotted with respect to the hardnesses in FIGS. 13 and 14. In FIG. 13, blank triangles (Δ) designate the torsional fatigue fracture resistance exhibited by the seamless steel tubes made from "TS" No. 2 without shot blasting, blank circles (◯) designate the torsional fatigue fracture resistance exhibited by the seamless steel tubes made from "TS" No. 3 without shot blasting, solid triangles (▲) designate the torsional fatigue fracture resistance exhibited by the hollow steel tubes made from "TS" No. 2 with shot blasting, and solid circles (●) designate the torsional fatigue fracture resistance exhibited by the hollow steel tubes made from "TS" No. 3 with shot blasting. In this examination, the text specimens were the seamless steel tubes and the hollow steel tubes which were hardened across the thickness, and which had an O.D. of 29.15 mm and an I.D. of 15 mm. In FIG. 14, solid circles (●) designate the torque exhibited by the hollow steel tubes hardened to 627 in Hv with shot blasting, and blank circles (◯) designate the torque exhibited by the hollow steel tubes hardened to 630 in Hv with shot blasting.

Moreover, the seamless steel tubes of Comparative Example No. 3 made from the "TS" No. 2 were visually examined for whether their breakages started either at their edges of the splines, at their ordinary outer peripheries, at the flaws in their inner peripheries. The results of the visual examinations are set forth in Table 6 below.

TABLE 6

| Hardness | 1,500* | 2,000* | 2,500* | 3,000* |
|---|---|---|---|---|
| Hv 460 | O.O.P. | O.O.P. | O.O.P. | O.O.P. |
| Hv 490 | O.O.P. | O.O.P. | O.O.P. | O.O.P. |
| Hv 550 | O.O.P. | O.O.P. | O.O.P. | O.O.P. |
| Hv 570 | O.O.P. | O.O.P. | O.O.P. | E.O.S. |
| Hv 625 | F.I.P. | E.O.S. | E.O.S. | E.O.S. |
| Hv 650 | F.I.P. | E.O.S. | E.O.S. | E.O.S. |
| Hv 675 | F.I.P. | F.I.P. | E.O.S. | E.O.S. |

(Note)
*Torsional Fatigue Fracture Resistance (N-m) at $2 \times 10^6$ times of repetition
O.O.P.: Breakages started at ordinary outer periphery (O.C.P.)
E.O.S.: Breakages started at edges of splines (E.O.S.)
F.I.P.: Breakages started at flaws in inner periphery (F.I.P.)

The hollow steel tubes were also produced in accordance with the Sixth Preferred Embodiment, and they were again examined for the torsional fatigue fracture resistances. The torsional fatigue fracture resistances thus obtained are also plotted with respect to the hardnesses in FIGS. 13 and 14 together with those of the seamless steel tubes of Comparative Example No. 3.

As can be appreciated from Table 6, the seamless steel tubes of Comparative Example No. 3 without being subjected to the shot blasting were likely to be broken starting at the flaws in their inner peripheries when they were hardened to higher hardnesses, and when they exhibited higher cut-off sensitivities.

Further, as illustrated with the dotted line in FIG. 13, the seamless steel tubes of Comparative Example No. 3 showed torsional fatigue fracture resistances degrading far more than the present hollow steel tubes did in the higher hardness region of 550 or more in Hv.

Furthermore, as illustrated in FIG. 14, the seamless steel tubes of Comparative Example No. 3 exhibited the "T" -"N" diagram (i.e., the relationship between the torque "T" (in N-m) and the number of repetitions "N" (in times)) which are deviated sharply to the lower torsional fatigue fracture resistances side as illustrated with the dotted line in the drawing. When the torsional fatigue fracture resistances exhibited by the seamless steel tubes of Comparative Example No. 3 at $2\times10^6$ times of repetition and those exhibited by the hollow steel tubes of the Sixth Preferred Embodiment at the same time of repetition, the seamless steel tubes of Comparative Example No. 3 were found to exhibit the torsional fatigue fracture resistances deteriorating far more than the hollow steel tubes of the Sixth Preferred Embodiment did.

Seventh Preferred Embodiment

Seamless steel tubes of a heavy thickness were rolled out of a variety of "TS's" by a seamless tubing process, and they had an O.D. of 29.15 mm and an I.D. of 15 mm. The compositions of the "TS's" are set forth in Table 7 below. The resulting seamless steel tubes were examined for their inner peripheries by the nondestructive inspection set forth in the "Second Preferred Embodiment" section in order to select seamless steel tubes whose inner peripheries contained flaws having a depth of less than 0.25 mm. The selected seamless steel tubes were corrected with the suction type shot blasting apparatus illustrated in FIG. 2, and thereby their inner peripheries were ground by 0.1 mm in order to correct at least the flaws having a width of 0.001 mm or less to have a depth of 0.15 mm or less.

TABLE 7

| Elements (% by weight) | 7-1 | 7-2 | 7-3 | 7-4 |
|---|---|---|---|---|
| C | 0.33 | 0.34 | 0.34 | 0.34 |
| Si | 0.27 | 0.24 | 0.24 | 0.22 |
| Mn | 1.71 | 0.51 | 0.52 | 0.51 |
| P | 0.013 | 0.011 | 0.014 | 0.011 |
| S | 0.007 | 0.009 | 0.007 | 0.007 |
| Cr | 0.76 | 1.0 | 0.20 | 0.15 |
| Mo | 0.04 | 0.02 | 0.29 | 0.02 |
| Ni | 0.02 | 0.07 | 0.02 | 0.02 |
| Ti | 0.01 | 0.01 | 0.01 | 0.01 |
| B | none | none | none | 0.0027 |

Figure 15:
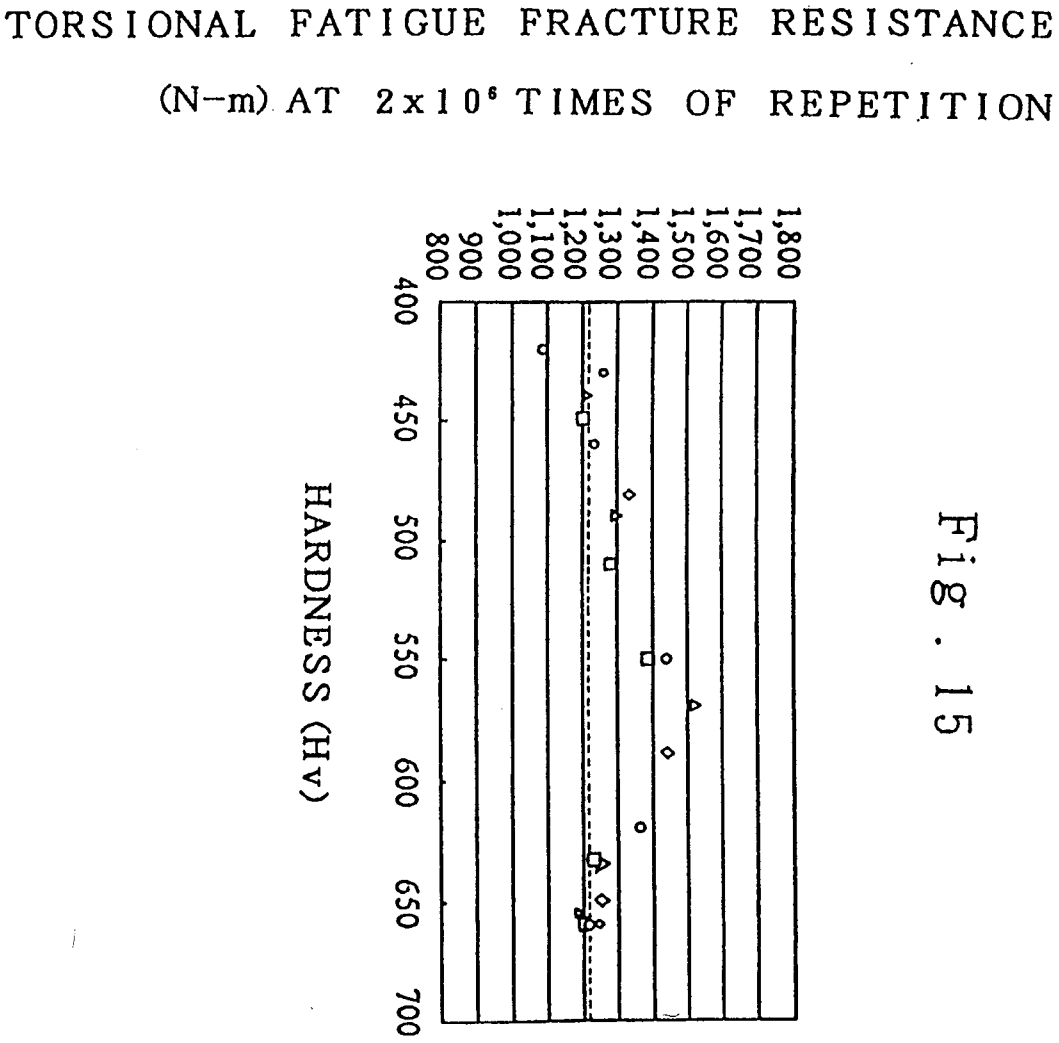
FIG. 15 is a scatter diagram illustrating relationships between torsional fatigue fracture resistances and hardnesses, relationships which were exhibited by hollow steel tubes hardened across the whole thickness in accordance with the Seventh Preferred Embodiment.

The thus corrected seamless steel tubes were hardened across the whole thickness, and thereafter they were adjusted to exhibit a variety of hardnesses in Hv by varying the tempering temperatures. The resulting hollow steel tubes were examined for the torsional fatigue fracture resistances. The torsional fatigue fracture resistances thus obtained are plotted with respect to the hardnesses in FIG. 15. In FIG. 15, blank circles (○) designate the torsional fatigue fracture resistance exhibited by the hollow steel tubes made from steel designated with "7-1" in Table 7, blank diamonds (◇) designate the torsional fatigue fracture resistance exhibited by the hollow steel tubes made from steel designated with "7-2" therein, blank triangles (Δ) designate the torsional fatigue fracture resistance exhibited by the hollow steel tubes made from steel designated with 7-3" therein, and blank squares (□) designate the torsional fatigue fracture resistance exhibited by the hollow steel tubes made from steel designated with "7-4" therein. In this examination, the test specimens were the hollow steel tubes which were hardened across the thickness, and which had an O.D. of 29.15 mm and an I.D. of 15 mm.

Figure 16:
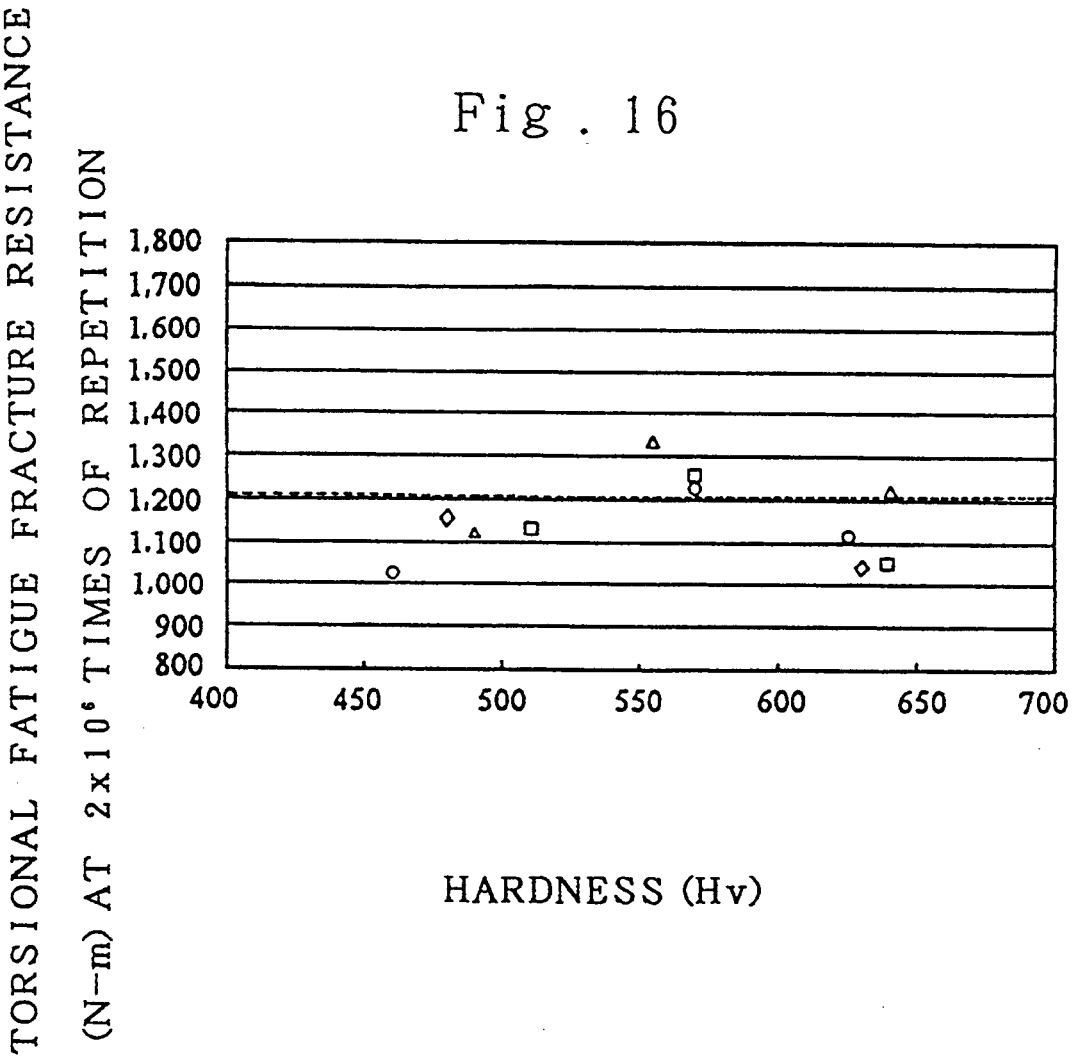
FIG. 16 is a scatter diagram illustrating relationships between torsional fatigue fracture resistances and hardnesses, relationships which were exhibited by solid steel bars hardened to a predetermined depth (i.e., Comparative Example No. 4)
Figure 17:
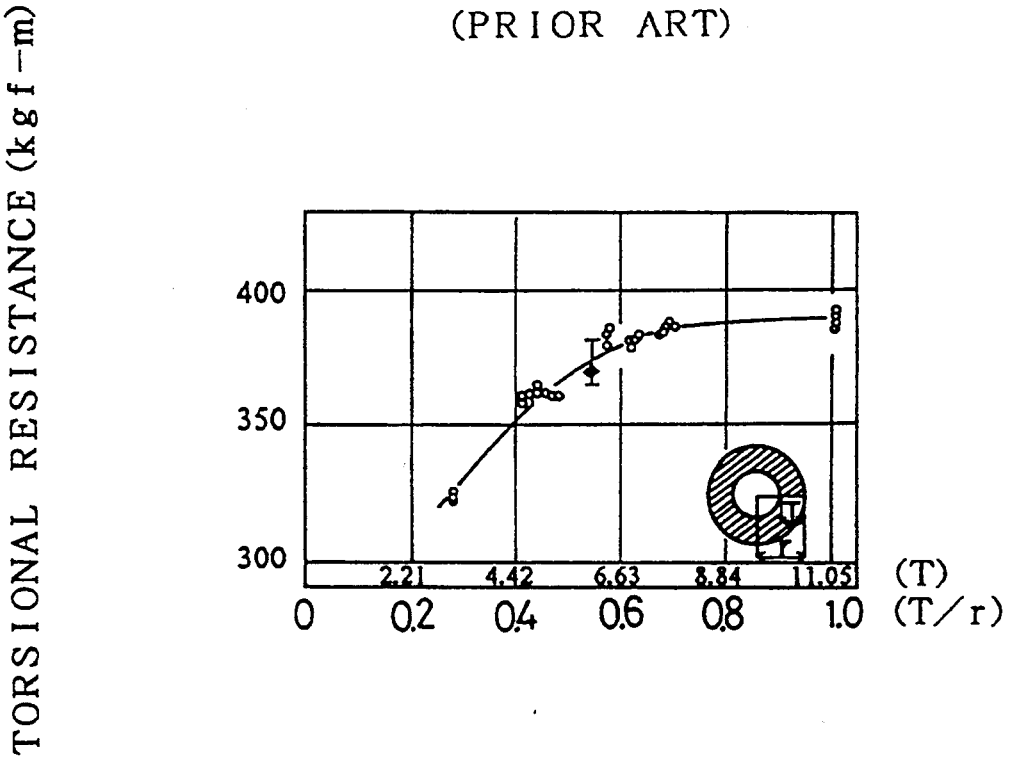
Fig. 17 (PRIOR ART)
FIG. 17 is a diagram illustrating relationships between torsional resistances and hardened depths, relationships which were exhibited by the conventional hollow steel tubes hardened to various hardened depths.

For comparison, solid steel bars were formed of the same "TS's" set forth in Table 7. The resulting solid steel bars were hardened to a depth of 4 mm (i.e., "T/r"=4/(29.15/2)=0.27), and thereafter they were adjusted to exhibit a variety of hardnesses in Hv by varying the tempering temperatures. The thus prepared solid steel bars (i.e., Comparative Example No. 4) were examined for the torsional fatigue fracture resistances. The torsional fatigue fracture resistances thus obtained are plotted with respect to the hardnesses in FIG. 16. In FIG. 16, blank circles (○) designate the torsional fatigue fracture resistance exhibited by the solid steel bars made from steel designated with "7-1" in Table 7, blank diamonds (◇) designate the torsional fatigue fracture resistance exhibited by the solid steel bars made from steel designated with "7-2" therein, blank triangles (Δ) designate the torsional fatigue fracture resistance exhibited by the solid steel bars made from steel designated with 7-3" therein, and blank squares (□) designate the torsional fatigue fracture resistance exhibited by the solid steel tubes made from steel designated with "7-4" therein. In this examination, the test specimens were the solid steel bars which were hardened to "T/r" of 0.27, and which had an O.D. of 29.15 mm.

The hollow steel tubes of the Seventh Preferred Embodiment included one of the additive elements falling in the ranges prescribed in accordance with the present invention, and they were hardened across the whole thickness in accordance therewith. As can be seen from FIG. 15, the hollow steel tubes of the Seventh Preferred Embodiment satisfied the standard torsional fatigue fracture resistance, e.g., 1,210 N-m at $2\times10^6$ times of repetition, when they were hardened to a hardness falling in a range of from 450 to 670 in Hr. Thus, the hollow steel tubes of the Seventh Preferred Embodiment were verified to produce the advantageous effects according to the present invention.

On the other hand, the solid steel bars of Comparative Example No. 4 were hardened to the depth of 4 mm. As can be understood from FIG. 16, some of the solid steel bars of Comparative Example No. 4 satisfied the standard torsional fatigue fracture resistance, e.g., 1,210 N-m at $2\times10^6$ times of repetition. However, generally speaking, the solid steel bars of Comparative Example No. 4 were found to exhibit unsatisfactory torsional fatigue fracture resistances which were degraded by about 200 N-m with respect to the hollow steel tubes of the Seventh Preferred Embodiment hardened across the whole thickness to the same hardness.

Having now fully described the present invention, it will be apparent to one of ordinary skill in the art that many changes and modifications can be made thereto without departing from the spirit or scope of the present invention as set forth herein including the appended claims.

What is claimed is:

1. A production process for producing a hollow steel tube of a high strength, comprising the steps of:

a tube preparation step of producing a seamless steel tube of a heavy thickness containing flaws of less than 0.25 mm in depth in an inner periphery thereof;

a tube inner periphery correction step of correcting at least said flaws having a width of 0.001 mm or less so as to have a depth of 0.15 mm or less; and a hardening step of hardening said seamless steel tube across a whole thickness thereof to a hardness of from 450 to 670 in Vickers hardness (Hv).

2. The production process according to claim 1, wherein said seamless steel tube is made from steel including at least one element selected from the group consisting of Mn in an amount of from 1.0 to 2.0% by weight, Cr in an amount of from 0.6 to 1.3% by weight, B in an amount of from 0.0005 to 0.0030% by weight and Mo in an amount of From 0.15 to 0.4% by weight.

3. The production process according to claim 2, wherein said steel includes at least one element selected from the group consisting of Mn in an amount of from 1.35 to 2.0% by weight, Cr in an amount of from 0.8 to 1.3% by weight, B in an amount of from 0.0008 to 0.0030% by weight and Mo in an amount of from 0.2 to 0.35% by weight.

4. The production process according to claim 1 or 2, wherein said seamless steel tube is made from steel including S in an amount of from 0.005 to 0.015% by weight.

5. The production process according to claim 4, wherein said steel includes S in an amount of from 0.007 to 0.013% by weight.

6. The production process according to claim 4, thereby adapting said hollow steel tube produced to exhibit a torsional fatigue fracture resistance of 1,210 N-m or more at $2\times10^6$ times of repetition.

7. The production process according to claim 4, thereby adapting said hollow steel tube produced to exhibit an impact strength of 400 kgf-m or more.

8. The production process according to claim 1, wherein said tube preparation step further includes an inspection step adapted for selecting said seamless steel tube containing said flaws of less than 0.25 mm in depth.

9. The production process according to claim 8, wherein said inspection step is carried out nondestructively with an electromagnetic ultrasonic thickness meter adapted for a leakage magnetic flux flaw detection.

10. The production process according to claim 1, wherein said tube inner periphery correction step is carried out by at least one of grinding, honing and shot blasting.

11. The production process according to claim 10, wherein said tube inner periphery correction step is carried out by shot blasting.

12. The production process according to claim 11, wherein said shot blasting is carried out with a suction type shot blasting apparatus.

13. The production process according to claim 1, wherein said tube inner periphery correction step is adapted for correcting at least said flaws having the width of 0.001 mm or less so as to have a depth of 0.1 mm or less.

14. The production process according to claim 1, wherein said hardening step is adapted for hardening said seamless steel tube across a whole thickness thereof from 480 to 630 in Vickers hardness (Hv).

15. The production process according to claim 1, wherein said hardening step is followed by a tempering step adapted for adjusting said hollow steel tube to exhibit a hardness falling in said hardness range.

16. The production process according to claim 1 or 2, thereby adapting said hollow steel tube produced to exhibit a torsional fatigue fracture resistance of 1,210 N-m or more at $2\times10^6$ times of repetition.

17. The production process according to claim 1 or 2, thereby adapting said hollow steel tube produced to exhibit an impact strength of 400 kgf-m or more.

* * * * *